US010069225B2

(12) United States Patent
Wanha et al.

(10) Patent No.: US 10,069,225 B2
(45) Date of Patent: Sep. 4, 2018

(54) HIGH SPEED BYPASS CABLE FOR USE WITH BACKPLANES

(71) Applicant: Molex, LLC, Lisle, IL (US)

(72) Inventors: Christopher D. Wanha, Dublin, CA (US); Brian Keith Lloyd, Maumelle, AR (US); Ebrahim Abunasrah, Little Rock, AR (US); Rehan Khan, Little Rock, AR (US); Javier Resendez, Streamwood, IL (US); Michael Rost, Lisle, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/433,749

(22) Filed: Feb. 15, 2017

(65) Prior Publication Data

US 2017/0162960 A1 Jun. 8, 2017

Related U.S. Application Data

(63) Continuation of application No. 15/290,638, filed on Oct. 11, 2016, now Pat. No. 9,608,348, which is a (Continued)

(51) Int. Cl.
*H01R 12/00* (2006.01)
*H01R 12/70* (2011.01)
(Continued)

(52) U.S. Cl.
CPC ..... *H01R 12/7076* (2013.01); *H01R 13/514* (2013.01); *H01R 13/6471* (2013.01); (Continued)

(58) Field of Classification Search
CPC ..... H01R 13/6473; H01R 13/6471; H01R 13/6474; H01R 13/6477; H01R 13/6587; (Continued)

(56) References Cited

U.S. PATENT DOCUMENTS 3,007,131 A 10/1961 Dahlgren et al.
3,594,613 A 7/1971 Prietula
(Continued)

FOREIGN PATENT DOCUMENTS

DE 3447556 A1 10/1986
JP 02-079571 U 6/1990
(Continued)

OTHER PUBLICATIONS

"File:Wrt54gl-layout.jpg-Embedded Xinu", Internet Citation, Sep. 8, 2006. Retrieved from the Internet: URL:http://xinu.mscs.mu.edu/File:Wrt54gl-layout.jpg [retrieved on Sep. 23, 2014].
(Continued)

*Primary Examiner* — Khiem Nguyen
(74) *Attorney, Agent, or Firm* — Stephen L. Sheldon

(57) ABSTRACT

A cable bypass assembly is disclosed for use in providing a high frequency transmission line that connect a chip package on a circuit board to connector spaced apart from the chip package. The bypass cable assembly has a structure that allows for low loss between the chip package and the connector. Multiple cables can be used to provide a number of differentially coupled channels.

18 Claims, 29 Drawing Sheets

Related U.S. Application Data continuation of application No. 15/162,264, filed on May 23, 2016, now Pat. No. 9,490,558, which is a continuation of application No. 14/973,095, filed on Dec. 17, 2015, now Pat. No. 9,362,678, which is a continuation of application No. 14/829,319, filed on Aug. 18, 2015, now Pat. No. 9,257,794, which is a continuation of application No. 14/486,838, filed on Sep. 15, 2014, now Pat. No. 9,142,921, which is a continuation-in-part of application No. 13/779,027, filed on Feb. 27, 2013, now Pat. No. 8,845,364.

(51) Int. Cl.

| | |
|---|---|
| ***H01R 13/514*** | (2006.01) |
| ***H01R 13/6471*** | (2011.01) |
| ***H01R 13/6474*** | (2011.01) |
| ***H01R 13/6587*** | (2011.01) |
| ***H01R 13/6592*** | (2011.01) |

(52) U.S. Cl.

CPC ..... *H01R 13/6474* (2013.01); *H01R 13/6587* (2013.01); *H01R 13/6592* (2013.01)

(58) Field of Classification Search

CPC ..... H01R 13/6592; H01R 13/514; H01R 12/7076

USPC ..... 439/78, 108, 607.5–607.7, 941

See application file for complete search history.

(56) References Cited

U.S. PATENT DOCUMENTS 4,072,387 A 2/1978 Sochor
4,083,615 A 4/1978 Volinskie
4,157,612 A 6/1979 Rainal
4,307,926 A 12/1981 Smith
4,417,779 A 11/1983 Wilson
4,508,403 A 4/1985 Weltman
4,615,578 A 10/1986 Stadler et al.
4,639,054 A 1/1987 Kersbergen
4,657,329 A 4/1987 Dechelette
4,679,321 A 7/1987 Plonski
4,697,862 A 10/1987 Hasircoglu
4,724,409 A 2/1988 Lehman
4,889,500 A 12/1989 Lazar et al.
4,924,179 A 5/1990 Sherman
4,948,379 A 8/1990 Evans
4,984,992 A 1/1991 Beamenderfer et al.
5,112,251 A 5/1992 Cesar
5,197,893 A 3/1993 Morlion et al.
5,332,979 A 7/1994 Roskewitsch
5,387,130 A 2/1995 Fedder et al.
5,402,088 A 3/1995 Pierro et al.
5,435,757 A 7/1995 Fedder et al.
5,441,424 A 8/1995 Morlion et al.
5,487,673 A 1/1996 Hurtarte
5,509,827 A 4/1996 Huppenthal et al.
5,554,038 A 9/1996 Morlion et al.
5,598,627 A 2/1997 Saka et al.
5,632,634 A 5/1997 Soes
5,691,506 A 11/1997 Miyazaki et al.
5,781,759 A 7/1998 Kashiwabara
6,004,139 A 12/1999 Dramstad
6,053,770 A 4/2000 Blom
6,083,046 A 7/2000 Wu et al.
6,095,872 A 8/2000 Lang
6,144,559 A 11/2000 Johnson et al.
6,156,981 A 12/2000 Ward et al.
6,203,376 B1 3/2001 Magajne et al.
6,255,741 B1 7/2001 Yoshihara
6,266,712 B1 7/2001 Henrichs
6,273,753 B1 8/2001 Ko
6,273,758 B1 8/2001 Lloyd et al.
6,366,471 B1 4/2002 Edwards et al.
6,368,120 B1 4/2002 Scherer
6,371,788 B1 4/2002 Bowling et al.
6,452,789 B1 9/2002 Pallotti et al.
6,489,563 B1 12/2002 Zhao et al.
6,535,367 B1 3/2003 Carpenter
6,574,115 B2 6/2003 Asano et al.
6,575,772 B1 6/2003 Soubh et al.
6,592,401 B1 7/2003 Gardner et al.
6,652,296 B2 11/2003 Kuroda et al.
6,652,318 B1 11/2003 Winings et al.
6,685,501 B1 2/2004 Wu et al.
6,692,262 B1 2/2004 Loveless
6,705,893 B1 3/2004 Ko
6,780,069 B2 8/2004 Scherer
6,797,891 B1 9/2004 Blair et al.
6,824,426 B1 11/2004 Spink, Jr.
6,843,657 B2 1/2005 Driscoll et al.
6,903,934 B2 6/2005 Lo
6,910,914 B1 6/2005 Spink, Jr.
6,916,183 B2 7/2005 Alger et al.
6,955,565 B2 10/2005 Lloyd et al.
6,969,270 B2 11/2005 Renfro
6,969,280 B2 11/2005 Chien
6,971,887 B1 12/2005 Trobough
7,004,765 B2 2/2006 Hsu
7,004,793 B2 2/2006 Scherer
7,044,772 B2 5/2006 McCreery
7,052,292 B2 5/2006 Hsu et al.
7,056,128 B2 6/2006 Driscoll et al.
7,066,756 B2 6/2006 Lange et al.
7,070,446 B2 7/2006 Henry
7,108,522 B2 9/2006 Verelst et al.
7,148,428 B2 12/2006 Meier et al.
7,168,961 B2 1/2007 Hsieh
7,175,446 B2 2/2007 Bright
7,192,300 B2 3/2007 Hashiguchi et al.
7,214,097 B1 5/2007 Hsu et al.
7,223,915 B2 5/2007 Hackman
7,234,944 B2 6/2007 Nordin et al.
7,244,137 B2 7/2007 Renfro et al.
7,280,372 B2 10/2007 Grundy et al.
7,307,293 B2 12/2007 Fjelstad et al.
7,331,816 B2 2/2008 Krohn
7,384,275 B2 6/2008 Ngo
7,394,665 B2 7/2008 Hamasaki et al.
7,402,048 B2 7/2008 Meier et al.
7,431,608 B2 10/2008 Sakaguchi et al.
7,445,471 B1 11/2008 Scherer et al.
7,462,924 B2 12/2008 Shuey
7,489,514 B2 2/2009 Hamasaki
7,534,142 B2 5/2009 Avery
7,549,897 B2 6/2009 Fedder
7,621,779 B2 11/2009 Laurx et al.
7,637,767 B2 12/2009 Davis
7,654,831 B1 2/2010 Wu
7,658,654 B2 2/2010 Ohyama
7,690,930 B2 4/2010 Chen et al.
7,719,843 B2 5/2010 Dunham
7,744,385 B2 6/2010 Scherer
7,744,403 B2 6/2010 Barr
7,744,414 B2 6/2010 Scherer et al.
7,748,988 B2 7/2010 Hori
7,771,207 B2 8/2010 Hamner et al.
7,789,529 B2 9/2010 Roberts
7,819,675 B2 10/2010 Ko et al.
7,824,197 B1 11/2010 Westman
7,857,629 B2 12/2010 Chin
7,857,630 B2 12/2010 Hermant et al.
7,862,344 B2 1/2011 Morgan et al.
7,892,019 B2 2/2011 Rao
7,906,730 B2 3/2011 Atkinson et al.
7,931,502 B2 4/2011 Iida
7,985,097 B2 7/2011 Gulla
7,997,933 B2 8/2011 Feldman
8,018,733 B2 9/2011 Jia
8,036,500 B2 10/2011 McColloch
8,157,573 B2 4/2012 Tanaka
8,162,675 B2 4/2012 Regnier
8,187,038 B2 5/2012 Kamiya

(56) References Cited

U.S. PATENT DOCUMENTS

| | | | |
|---|---|---|---|
| 8,192,222 | B2 | 6/2012 | Kameyama |
| 8,226,441 | B2 | 7/2012 | Regnier |
| 8,308,491 | B2 | 11/2012 | Nichols et al. |
| 8,337,243 | B2 | 12/2012 | Elkhatib et al. |
| 8,338,713 | B2 | 12/2012 | Fjelstad et al. |
| 8,398,433 | B1 | 3/2013 | Yang |
| 8,419,472 | B1 | 4/2013 | Swanger et al. |
| 8,435,074 | B1 | 5/2013 | Grant |
| 8,439,704 | B2 | 5/2013 | Reed |
| 8,449,312 | B2 | 5/2013 | Lang |
| 8,449,330 | B1 | 5/2013 | Schroll |
| 8,465,302 | B2 | 6/2013 | Regnier |
| 8,480,413 | B2 | 7/2013 | Minich |
| 8,517,765 | B2 | 8/2013 | Schroll |
| 8,535,069 | B2 | 9/2013 | ZHang |
| 8,540,525 | B2 | 9/2013 | Regnier |
| 8,553,102 | B2 | 10/2013 | Yamada |
| 8,575,491 | B2 | 11/2013 | Gundel et al. |
| 8,575,529 | B2 | 11/2013 | Asahi |
| 8,588,561 | B2 | 11/2013 | Zbinden |
| 8,597,055 | B2 | 12/2013 | Regnier |
| 8,651,890 | B2 | 2/2014 | Chiarelli |
| 8,672,707 | B2 | 3/2014 | Nichols et al. |
| 8,690,604 | B2 | 4/2014 | Davis |
| 8,715,003 | B2 | 5/2014 | Buck et al. |
| 8,740,644 | B2 | 6/2014 | Long |
| 8,747,158 | B2 | 6/2014 | Szczesny |
| 8,753,145 | B2 | 6/2014 | Lang |
| 8,758,051 | B2 | 6/2014 | Nonen et al. |
| 8,764,483 | B2 | 7/2014 | Ellison |
| 8,784,122 | B2 | 7/2014 | Soubh |
| 8,787,711 | B2 | 7/2014 | Zbinden |
| 8,794,991 | B2 | 8/2014 | Ngo |
| 8,804,342 | B2 | 8/2014 | Behziz et al. |
| 8,814,595 | B2 | 8/2014 | Cohen et al. |
| 8,834,190 | B2 | 9/2014 | Ngo |
| 8,864,521 | B2 | 10/2014 | Atkinson et al. |
| 8,888,533 | B2 | 11/2014 | Westman et al. |
| 8,905,767 | B2 | 12/2014 | Putt, Jr. et al. |
| 8,911,255 | B2 | 12/2014 | Scherer et al. |
| 8,926,342 | B2 | 1/2015 | Vinther |
| 8,926,377 | B2 | 1/2015 | Kirk |
| 8,992,236 | B2 | 3/2015 | Wittig |
| 8,992,237 | B2 | 3/2015 | Regnier |
| 8,992,258 | B2 | 3/2015 | Raschilla |
| 9,011,177 | B2 | 4/2015 | Lloyd |
| 9,028,281 | B2 | 5/2015 | Kirk |
| 9,035,183 | B2 | 5/2015 | Kodama et al. |
| 9,040,824 | B2 | 5/2015 | Guetig et al. |
| 9,054,432 | B2 | 6/2015 | Yang |
| 9,071,001 | B2 | 6/2015 | Scherer et al. |
| 9,119,292 | B2 | 8/2015 | Gundel |
| 9,136,652 | B2 | 9/2015 | Ngo |
| 9,142,921 | B2 | 9/2015 | Wanha et al. |
| 9,155,214 | B2 | 10/2015 | Ritter |
| 9,160,123 | B1 | 10/2015 | Pao |
| 9,160,151 | B2 | 10/2015 | Vinther |
| 9,161,463 | B2 | 10/2015 | Takamura |
| 9,166,320 | B1 | 10/2015 | Herring |
| 9,196,983 | B2 | 11/2015 | Saur et al. |
| 9,203,171 | B2 | 12/2015 | Yu |
| 9,209,539 | B2 | 12/2015 | Herring |
| 9,214,756 | B2 | 12/2015 | Nishio |
| 9,214,768 | B2 | 12/2015 | Pao |
| 9,232,676 | B2 | 1/2016 | Sechrist et al. |
| 9,246,251 | B2 | 1/2016 | Regnier |
| 9,277,649 | B2 | 3/2016 | Ellison |
| 9,312,618 | B2 | 4/2016 | Regnier |
| 9,331,432 | B1 | 5/2016 | Phillips |
| 9,350,108 | B2 | 5/2016 | Long |
| 9,356,366 | B2 | 5/2016 | Moore |
| 9,385,455 | B2 | 7/2016 | Regnier |
| 9,391,407 | B1 | 7/2016 | Bucher |
| 9,401,563 | B2 | 7/2016 | Simpson |
| 9,413,090 | B2 | 8/2016 | Nagamine |
| 9,413,112 | B2 | 8/2016 | Helster |
| 9,431,773 | B2 | 8/2016 | Chen |
| 9,437,981 | B2 | 9/2016 | Wu |
| 9,455,538 | B2 | 9/2016 | Nishio |
| 9,484,671 | B2 | 11/2016 | Zhu |
| 9,484,673 | B1 | 11/2016 | Yang |
| 9,490,587 | B1 | 11/2016 | Phillips |
| 9,496,655 | B1 | 11/2016 | Huang |
| 9,515,429 | B2 | 12/2016 | DeGeest |
| 9,525,245 | B2 | 12/2016 | Regnier |
| 9,543,688 | B2 | 1/2017 | Pao |
| 9,553,381 | B2 | 1/2017 | Regnier |
| 9,559,465 | B2 | 1/2017 | Phillips |
| 9,565,780 | B2 | 2/2017 | Nishio |
| 9,608,388 | B2 | 3/2017 | Kondo |
| 9,608,590 | B2 | 3/2017 | Hamner |
| 9,627,818 | B1 | 4/2017 | Chen |
| 9,660,364 | B2 | 5/2017 | Wig et al. |
| 9,666,998 | B1 | 5/2017 | deBoer |
| 9,673,570 | B2 | 6/2017 | Briant |
| 9,812,799 | B2 | 11/2017 | Wittig |
| 2001/0016438 | A1 | 8/2001 | Reed |
| 2002/0111067 | A1 | 8/2002 | Sakurai et al. |
| 2002/0157865 | A1 | 10/2002 | Noda |
| 2003/0064616 | A1 | 4/2003 | Reed et al. |
| 2003/0073331 | A1 | 4/2003 | Peloza |
| 2003/0222282 | A1 | 12/2003 | Fjelstad et al. |
| 2004/0094328 | A1 | 5/2004 | Fjelstad et al. |
| 2004/0121633 | A1 | 6/2004 | David et al. |
| 2004/0155328 | A1 | 8/2004 | Kline |
| 2004/0229510 | A1 | 11/2004 | Lloyd et al. |
| 2004/0264894 | A1 | 12/2004 | Cooke |
| 2005/0006126 | A1 | 1/2005 | Aisenbrey |
| 2005/0051810 | A1 | 3/2005 | Funakura |
| 2005/0093127 | A1 | 5/2005 | Fjelstad et al. |
| 2005/0130490 | A1 | 6/2005 | Rose |
| 2005/0142944 | A1 | 6/2005 | Ling |
| 2005/0239339 | A1 | 10/2005 | Pepe |
| 2006/0001163 | A1 | 1/2006 | Kolbehdari et al. |
| 2006/0035523 | A1 | 2/2006 | Kuroda et al. |
| 2006/0038287 | A1 | 2/2006 | Hamasaki |
| 2006/0079102 | A1 | 4/2006 | DeLessert |
| 2006/0079119 | A1 | 4/2006 | Wu |
| 2006/0091507 | A1 | 5/2006 | Fjelstad et al. |
| 2006/0114016 | A1 | 6/2006 | Suzuki |
| 2006/0160399 | A1 | 7/2006 | Dawiedczyk |
| 2006/0189212 | A1 | 8/2006 | Avery |
| 2006/0194475 | A1 | 8/2006 | Miyazaki |
| 2006/0216969 | A1 | 9/2006 | Bright |
| 2006/0228922 | A1 | 10/2006 | Morriss |
| 2006/0234556 | A1 | 10/2006 | Wu |
| 2006/0238991 | A1 | 10/2006 | Drako |
| 2006/0282724 | A1 | 12/2006 | Roulo |
| 2006/0292898 | A1 | 12/2006 | Meredith |
| 2007/0032104 | A1 | 2/2007 | Yamada |
| 2007/0141871 | A1 | 6/2007 | Scherer |
| 2007/0243741 | A1 | 10/2007 | Yang |
| 2008/0131997 | A1 | 6/2008 | Kim et al. |
| 2008/0171476 | A1 | 7/2008 | Liu |
| 2008/0297988 | A1 | 12/2008 | Chau |
| 2008/0305689 | A1 | 12/2008 | Zhang et al. |
| 2009/0023330 | A1 | 1/2009 | Stoner et al. |
| 2009/0166082 | A1 | 7/2009 | Liu et al. |
| 2009/0215309 | A1 | 8/2009 | Mongold |
| 2010/0068944 | A1 | 3/2010 | Scherer |
| 2010/0112850 | A1 | 5/2010 | Rao |
| 2010/0159829 | A1 | 6/2010 | McCormack |
| 2010/0177489 | A1 | 7/2010 | Yagisawa |
| 2010/0203768 | A1 | 8/2010 | Kondo |
| 2011/0074213 | A1 | 3/2011 | Schaffer |
| 2011/0080719 | A1 | 4/2011 | Jia |
| 2011/0136387 | A1 | 6/2011 | Matsuura |
| 2011/0177699 | A1 | 7/2011 | Crofoot et al. |
| 2011/0212633 | A1 | 9/2011 | Regnier |
| 2011/0230104 | A1 | 9/2011 | Lang |
| 2011/0263156 | A1 | 10/2011 | Ko |
| 2011/0300757 | A1 | 12/2011 | Regnier |
| 2011/0304966 | A1 | 12/2011 | Schrempp |
| 2012/0003848 | A1 | 1/2012 | Casher |

(56) References Cited

U.S. PATENT DOCUMENTS

| | | | |
|---|---|---|---|
| 2012/0034820 | A1 | 2/2012 | Lang |
| 2012/0225585 | A1 | 9/2012 | Lee |
| 2012/0246373 | A1 | 9/2012 | Chang |
| 2013/0005178 | A1 | 1/2013 | Straka et al. |
| 2013/0012038 | A1 | 1/2013 | Kirk |
| 2013/0017715 | A1 | 1/2013 | van Laarhoven |
| 2013/0040482 | A1 | 2/2013 | Ngo |
| 2013/0092429 | A1 | 4/2013 | Ellison |
| 2013/0148321 | A1 | 6/2013 | Liang |
| 2013/0340251 | A1 | 12/2013 | Regnier |
| 2014/0041937 | A1 | 2/2014 | Lloyd et al. |
| 2014/0073173 | A1 | 3/2014 | Yang |
| 2014/0073174 | A1 | 3/2014 | Yang |
| 2014/0073181 | A1 | 3/2014 | Yang |
| 2014/0217571 | A1 | 8/2014 | Ganesan et al. |
| 2014/0242844 | A1 | 8/2014 | Wanha |
| 2014/0273551 | A1 | 9/2014 | Resendez |
| 2014/0273594 | A1 | 9/2014 | Jones et al. |
| 2014/0335736 | A1 | 11/2014 | Regnier |
| 2015/0079845 | A1 | 3/2015 | Wanha |
| 2015/0090491 | A1 | 4/2015 | Dunwoody |
| 2015/0180578 | A1 | 6/2015 | Leigh et al. |
| 2015/0207247 | A1 | 7/2015 | Regnier et al. |
| 2016/0013596 | A1 | 1/2016 | Regnier |
| 2016/0064119 | A1 | 3/2016 | Grant |
| 2016/0104956 | A1 | 4/2016 | Santos |
| 2016/0181713 | A1 | 6/2016 | Peloza |
| 2016/0190720 | A1 | 6/2016 | Lindkamp |
| 2016/0190747 | A1 | 6/2016 | Regnier |
| 2016/0197423 | A1 | 7/2016 | Regnier |
| 2016/0218455 | A1 | 7/2016 | Sayre |
| 2016/0233598 | A1 | 8/2016 | Wittig |
| 2016/0233615 | A1 | 8/2016 | Scholeno |
| 2016/0336692 | A1 | 11/2016 | Champion |
| 2016/0380383 | A1 | 12/2016 | Lord |
| 2017/0033482 | A1 | 2/2017 | Liao |
| 2017/0033509 | A1 | 2/2017 | Liao |
| 2017/0077621 | A1 | 3/2017 | Liao |
| 2017/0098901 | A1 | 4/2017 | Regnier |
| 2017/0110222 | A1 | 4/2017 | Liptak et al. |
| 2017/0162960 | A1 | 6/2017 | Wanha |
| 2017/0302036 | A1 | 10/2017 | Regnier |
| 2017/0365942 | A1 | 10/2017 | Regnier |
| 2018/0034175 | A1 | 2/2018 | Lloyd |

FOREIGN PATENT DOCUMENTS

| | | | |
|---|---|---|---|
| JP | 04-14372 | U1 | 2/1992 |
| JP | 2008-041285 | A | 2/2008 |
| JP | 2008-059857 | A | 3/2008 |
| JP | 2009-043590 | A | 2/2009 |
| JP | 2010-017388 | A | 1/2010 |
| TW | M359141 | U | 6/2009 |
| TW | M408835 | U | 8/2011 |
| TW | 201225455 | A | 6/2012 |
| WO | WO 2008-072322 | A1 | 6/2008 |
| WO | WO 2012-078434 | A2 | 6/2012 |
| WO | WO 2013-006592 | A2 | 1/2013 |

OTHER PUBLICATIONS

U.S. Appl. No. 61/714,871, dated Oct. 17, 2012, Wig et al.

Amphenol Aerospace, "Size 8 High Speed Quadrax and Differential Twinax Contacts for Use in MIL-DTL-38999 Special Subminiature Cylindrical and ARINC 600 Rectangular Connectors", published May 2008. Retrieved from www.peigenesis.com/images/content/news/amphenol_quadrax.pdf.

Hitachi Cable America Inc., "Direct Attach Cables: OMNIBIT supports 25 Gbit/s interconnections". Retrieved Aug. 10, 2017 from www.hca.hitachi-cable.com/products/hca/catalog/pdfs/direct-attach-cable-assemblies.pdf.

Agilent, "Designing Scalable 10G Backplane Interconnect Systems Utilizing Advanced Verification Methodologies," White Paper, Published May 5, 2012, USA.

Amphenol TCS, "Amphenol TCS expands the XCede Platform with 85 Ohm Connectors and High-Speed Cable Solutions," Press Release, Published Feb. 25, 2009, http://www.amphenol.com/about/news_archive/2009/58.

HIGH SPEED BYPASS CABLE FOR USE WITH BACKPLANES

REFERENCE TO RELATED APPLICATIONS

This Application is a continuation of U.S. application Ser. No. 15/290,638, filed Oct. 11, 2016, now U.S. Pat. No. 9,608,348, which in turn is a continuation of U.S. application Ser. No. 15/162,264, filed May 23, 2016, now U.S. Pat. No. 9,490,558, which in turn is a continuation of U.S. application Ser. No. 14/973,095 filed Dec. 17, 2015, now U.S. Pat. No. 9,362,678, which is a continuation of U.S. application Ser. No. 14/829,319, filed Aug. 18, 2015, now U.S. Pat. No. 9,257,794, which is a continuation of and claims priority to U.S. application Ser. No. 14/486,838, filed Sep. 15, 2014, now U.S. Pat. No. 9,142,921, which is a Continuation-In-Part Application of and claims priority to U.S. application Ser. No. 13/779,027, filed on Feb. 27, 2013, now U.S. Pat. No. 8,845,364, all of which are incorporated herein by reference in their entirety.

BACKGROUND OF THE PRESENT DISCLOSURE

The Present Disclosure relates, generally, to cable interconnection systems, and, more particularly, to bypass cable interconnection systems for transmitting high speed signals at low losses from chips or processors to backplanes.

Conventional cable interconnection systems are found in electronic devices such as routers, servers and the like, and are used to form signal transmission lines between a primary chip member mounted on a printed circuit board of the device, such as an ASIC, and a connector mounted to the circuit board. The transmission line typically takes the form of a plurality of conductive traces that are etched, or otherwise formed, on or as part of the printed circuit board. These traces extend between the chip member and a connector that provides a connection between one or more external plug connectors and the chip member. Circuit boards are usually formed from a material known as FR-4, which is inexpensive. However, FR-4 is known to promote losses in high speed signal transmission lines, and these losses make it undesirable to utilize FR-4 material for high speed applications of about 10 Gbps and greater. This drop off begins at 6 GBps and increases as the data rate increases.

Custom materials for circuit boards are available that reduce such losses, but the prices of these materials severely increase the cost of the circuit board and, consequently, the electronic devices in which they are used. Additionally, when traces are used to form the signal transmission line, the overall length of the transmission line typically may well exceed 10 inches in length. These long lengths require that the signals traveling through the transmission line be amplified and repeated, thereby increasing the cost of the circuit board, and complicating the design inasmuch as additional board space is needed to accommodate these amplifiers and repeaters. In addition, the routing of the traces of such a transmission line in the FR-4 material may require multiple turns. These turns and the transitions that occur at terminations affect the integrity of the signals transmitted thereby. It then becomes difficult to route transmission line traces in a manner to achieve a consistent impedance and a low signal loss therethough.

It therefore becomes difficult to adequately design signal transmission lines in circuit boards, or backplanes, to meet the crosstalk and loss requirements needed for high speed applications. It is desirable to use economical board materials such as FR4, but the performance of FR4 falls off dramatically as the data rate approaches 10 Gbps, driving designers to use more expensive board materials and increasing the overall cost of the device in which the circuit board is used. Accordingly, the Present Disclosure is therefore directed to a high speed, bypass cable assembly that defines a transmission line for transmitting high speed signals, at 10 GBps and greater which removes the transmission line from the body of the circuit board or backplane, and which has low loss characteristics.

SUMMARY OF THE PRESENT DISCLOSURE

Accordingly, there is provided an improved high speed bypass cable assembly that defines a signal transmission line useful for high speed applications at 10 GBps or above and with low loss characteristics.

In accordance with an embodiment described in the Present Disclosure, an electrical cable assembly can be used to define a high speed transmission line extending between an electronic component, such as a chip, or chip set, and a predetermined location on a backplane. Inasmuch as the chip is typically located a long length from the aforesaid location, the cable assembly acts a signal transmission line that that avoids, or bypasses, the landscape of the circuit board construction and which provides an independent signal path line that has a consistent geometry and structure that resists signal loss and maintains its impedance at a consistent level without great discontinuity.

In accordance with the Present Disclosure, the cable may include one or more cables which contain dedicated signal transmission lines in the form of pairs of wires that are enclosed within an outer, insulative covering and which are known in the art as "twin-ax" wires. The spacing and orientation of the wires that make up each such twin-ax pair can be easily controlled in a manner such that the cable assembly provides a transmission line separate and apart from the circuit board, and which extends between a chip or chip set and a connector location on the circuit board. Preferably, a backplane style connector is provided, such as a pin header or the like, which defines a transition that does not inhibit the signal transmission. The cable twin-ax wires are terminated directly to the termination tails of a mating connector so that crosstalk and other deleterious factors are kept to a minimum at the connector location.

The signal wires of the bypass cable are terminated to terminal tails of the connector which are arranged in a like spacing so as to emulate the ordered geometry of the cable. The cable connector includes connector wafers that include ground terminals that encompass the signal terminals so that the ground shield(s) of the cable may be terminated to the connector and define a surrounding conductive enclosure to provide both shielding and reduction of cross talk. The termination of the wires of the bypass cable assembly is done in such a manner that to the extent possible, the geometry of the signal and ground conductors in the bypass cable is maintained through the termination of the cable to the board connector.

The cable wires are preferably terminated to blade-style terminals in each connector wafer, which mate with opposing blade portions of corresponding terminals of a pin header. The pin header penetrates through the intervening circuit board and the pins of the header likewise mate with like cable connectors on the other side of the circuit board. In this manner, multiple bypass cable assemblies may be used as signal transmission paths. This structure eliminates the need for through-hole or compliant pin connectors as well as avoids the need for long and possibly complex routing paths in the circuit board. As such, a designer may use inexpensive FR4 material for the circuit board construction, but still obtain high speed performance without degrading losses.

The signal conductors of the twin-ax cables are terminated to corresponding signal terminal tail portions of their respective corresponding connector wafers. The grounding shield of each twin-ax pair of wires is terminated to two corresponding ground terminal tail portions which flank the pair of signal terminals. In this manner, each pair of signal terminals is flanked by two ground terminals therewithin. The connector wafers have a structure that permits them to support the terminals thereof in a G-S-S-G pattern within each wafer. Pairs of wafers are mated together to form a cable connector and, when mated together, the signal terminals of one wafer are flanked by ground terminals of an adjacent wafer. In this manner, the cable twin-ax wires are transitioned reliably to connector terminals in a fashion suitable for engaging a backplane connector, while shielding the cable wire signal pairs so that any impedance discontinuities are reduced.

In one embodiment, grounding cradles are provided for each twin-ax wire pair so that the grounding shield for each twin-ax wire may be terminated to the two corresponding grounding terminals that flank the pair of the interior signal terminals. In this manner, the geometry and spacing of the cable signal wires is maintained to the extent possible through the connector termination area. The connector terminals are configured to minimize the impedance discontinuity occurring through the connector so that designed impedance tolerances may be maintained through the connector system.

In another embodiment, a grounding member is provided that holds the twin-ax wires in position for attachment to the conductors of a corresponding opposing backplane, or wafer connector. The grounding member includes a ground strip, or bar, that extends transversely to the wafer connector conductors. The grounding member preferably includes one or more cable clamps which extend out therefrom in a manner so as to provide a clamping nest that receives one of the twin-ax wires therein. The cable clamps include contact arms that are wrapped around the outer shielding of the twin-ax cable wires and which may be crimped therearound, or otherwise attached to the twin-ax outer shielding to ensure reliable electrical contact therebetween.

The ground strip preferably extends transversely to the twin-ax wires and the conductors of the wafer connectors. The ground strip is structured to support the cables in a predetermined spacing and this configuration may include depressions, or shoulders formed in the strip to provide a baseline, or datum for properly locating the twin-ax wire conductors. The free ends of the ground conductors may be offset in a selected plane beneath the centerlines of the twin-ax wire conductors. In this manner, the signal conductors of the twin-ax wires will be at or very close to the level of the wafer connector signal conductor mating surfaces. The ground strip is preferably welded to the wafer connector ground conductors, although other suitable manners of attachment in the art may be used.

The cable clamps may be crimped to the outer shielding members of each twin-ax cable and the cable clamps, the ground strip, free ends of the twin-ax cables and free ends of the connector terminals are disposed in a termination area of the wafer connector. This area is overmolded with a dielectric material that forms a solid mass that is joined to the connector frame. The ground strip commons the outer shielding members of the twin-ax wires together, as well as the ground terminals of the connector to provide a reliable ground path.

These and other objects, features and advantages of the Present Disclosure will be clearly understood through a consideration of the following detailed description.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 1:
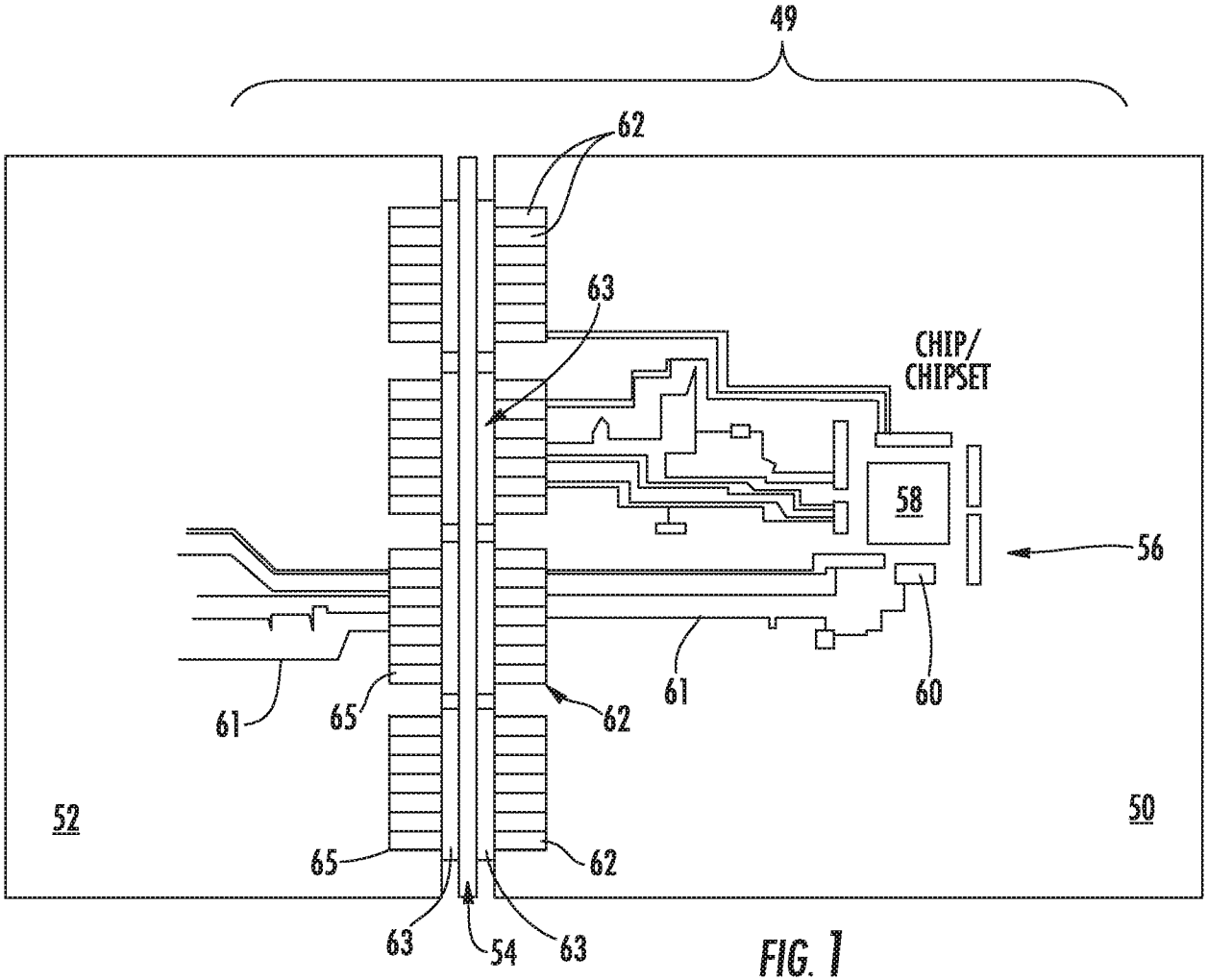
FIG. 1 is a plan view of a typical backplane system with a chipset being interconnected to a series of backplane connectors.

FIG. 1 is a plan view of a conventional circuit board, or backplane assembly 49 that has a primary circuit board 50 that is connected to another, secondary circuit board 52 by way of an intervening circuit board, or backplane 54. The primary circuit board 50 has an array of electronic components disposed on it, including a chip set 56 that may include a base processor 58 or the like as well as a plurality of ancillary chips or processors 60. The chips 58, 60 may take the form of a PHY Chip, or any other surface-mounted, physical layer device, known in the art, from which a high speed signal is generated, such as an ASIC or the like. The primary circuit board 50 is provided with a plurality of circuit paths that are arranged in various layers of the board and which are formed from conductive traces 61. These conductive traces 61 sometimes follow long and torturous paths as they traverse the circuit board 50 from the chipset 56 to another location of the circuit board 50, such as a termination area near the edge of the circuit board 50 where a series of connectors 62 are mounted. The connectors 62 mate with corresponding mating connectors 63, mounted on the backplane 54 and these connectors 63 may commonly be of the pin header style, having an insulative body 66 and a plurality of conductive pins, or blades 67, that extend outward therefrom and which are contacted by opposing terminals of the connectors 62. The pins 67 of the connector 63 extend through the intervening circuit board 54 where they may mate with other connectors 65 disposed on the opposite side and on the secondary circuit board 52.

The board connectors 62, 65 typically utilize compliant mounting pins (not shown) for connecting to the circuit boards 50, 52. With compliant mounting pins, not only does the circuit board 50, 52 need to have mounting holes drilled into it and plated vias formed therein, but the risk exists that the plated vias may retain stub portions that act as unterminated transmission lines which can degrade the transmitted signals and contribute impedance discontinuities and crosstalk. In order to eliminate stubs and their deleterious effects on high speed signal transmission, vias need to be backdrilled, but this modification to the circuit board adds cost to the overall system. Long conductive traces 61 in circuit board material, such as FR4, become lossy at high speeds, which adds another negative aspect to high speed signal transmission on low cost circuit boards. High data speeds are those beginning at about 5 Ghz and extending to between about 10 and about 15 Ghz as well as speeds in excess thereof. There are ways to compensate for these losses such as utilizing chip clock data recovery systems, amplifiers or repeaters, but the use of these systems/components adds complexity and cost to the system.

In order to eliminate the inherent losses that occur in FR4 and other inexpensive, similar circuit board materials, we have developed a bypass cable system in which we utilize multi-wire cables for high speed, differential signal transmission. The cable wires can, in some instances, provide signal transmission lines from the chip/chip set to a connector location. In other instances, the cable wires may provide signal transmission lines between components on the circuit board, such as chips, processors, relays, amplifiers and the like, and even between nodes formed on or in the circuit board where different traces meet, and other connectors, such as backplane connectors.

These cables take the transmission line off of the circuit boards 50, 52 and utilize wires, primarily wires of the twin-ax construction to route a transmission line from the chipset to another location on the circuit board 50, 52. In this application, the cable terminus is a backplane-style connector 62, 65. As shown best schematically in FIG. 2, a series of bypass cable assemblies 66, each including a plurality of twin-ax wires 69, are provided and they are connected at one end thereof to the chips 58, 60 and to backplane connectors 62, 65 at their opposite ends. These connectors 62, 65 mate with the pin header connectors 63 on the intervening circuit board 54 and provide a passage through that circuit board 54 between the primary and secondary circuit boards 50, 52.

Figure 2A:
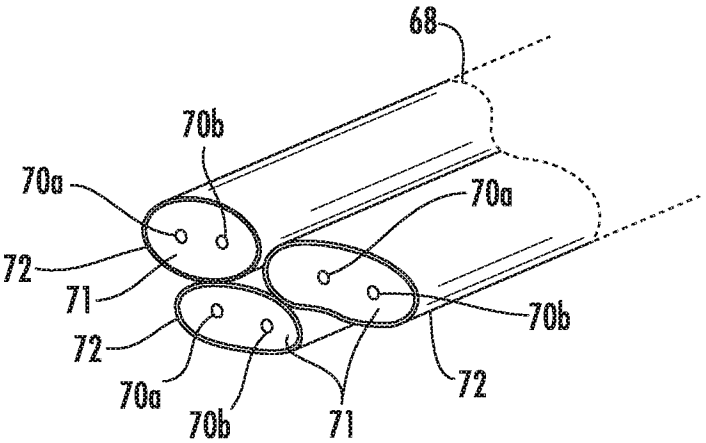
FIG. 2A is a perspective sectional view of a multi-wire cable used in conjunction with cable bypass assemblies of the Present Disclosure.
Figure 2:
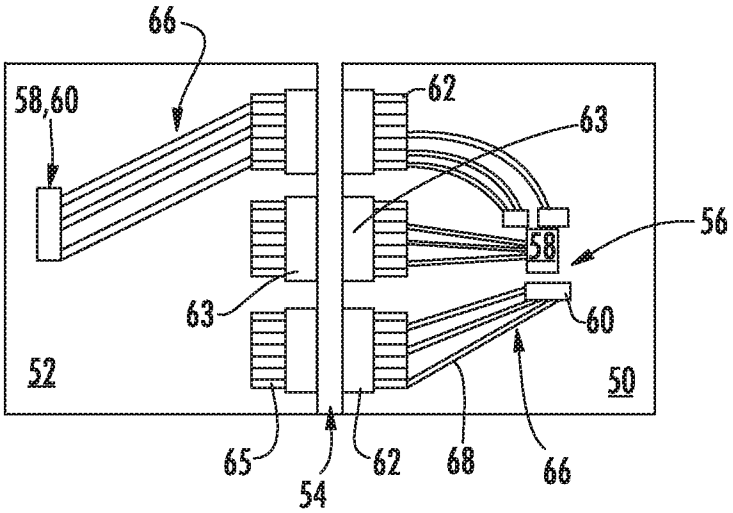
FIG. 2 is a plan view of a backplane system utilizing bypass cable assemblies constructed in accordance with the Present Disclosure.

The bypass cable assemblies 66 include a flexible circuit member, shown in the Figures as a multiple wire cable 68. The cable 68, as shown in FIG. 2A, may include an outer covering that contains a plurality of signal transmission wires 69, each of which contains two signal conductors 70*a*, 70*b* that are arranged in a spaced-apart fashion that is enclosed by an insulative portion 71. The insulative portion 71 of each such twin-ax wire 69 typically includes a conductive outer shield 72 that encloses the insulative portion 71 and its signal conductors 70*a-b*. The multiple cable wires 69 may be enclosed as a group by an outer insulative covering, which is shown in phantom in the Figures, or it may include only a plurality of the twin-ax wires. The signal conductors 70*a-b*, as is known in the art, are separated by a predetermined spacing and are used to transmit differential signals, i.e., signals of the same magnitude, but different polarity, such as +0.5 v and −0.5 v. The structure of the twin-ax wires lends itself to uniformity throughout its length so that a consistent impedance profile is attained for the entire length of the wires 69, or cables 68. The cable assemblies 66 of this Present Disclosure may include as few as one or two twin-ax wires, or they may include greater numbers as shown in the Figures.

Figure 3:
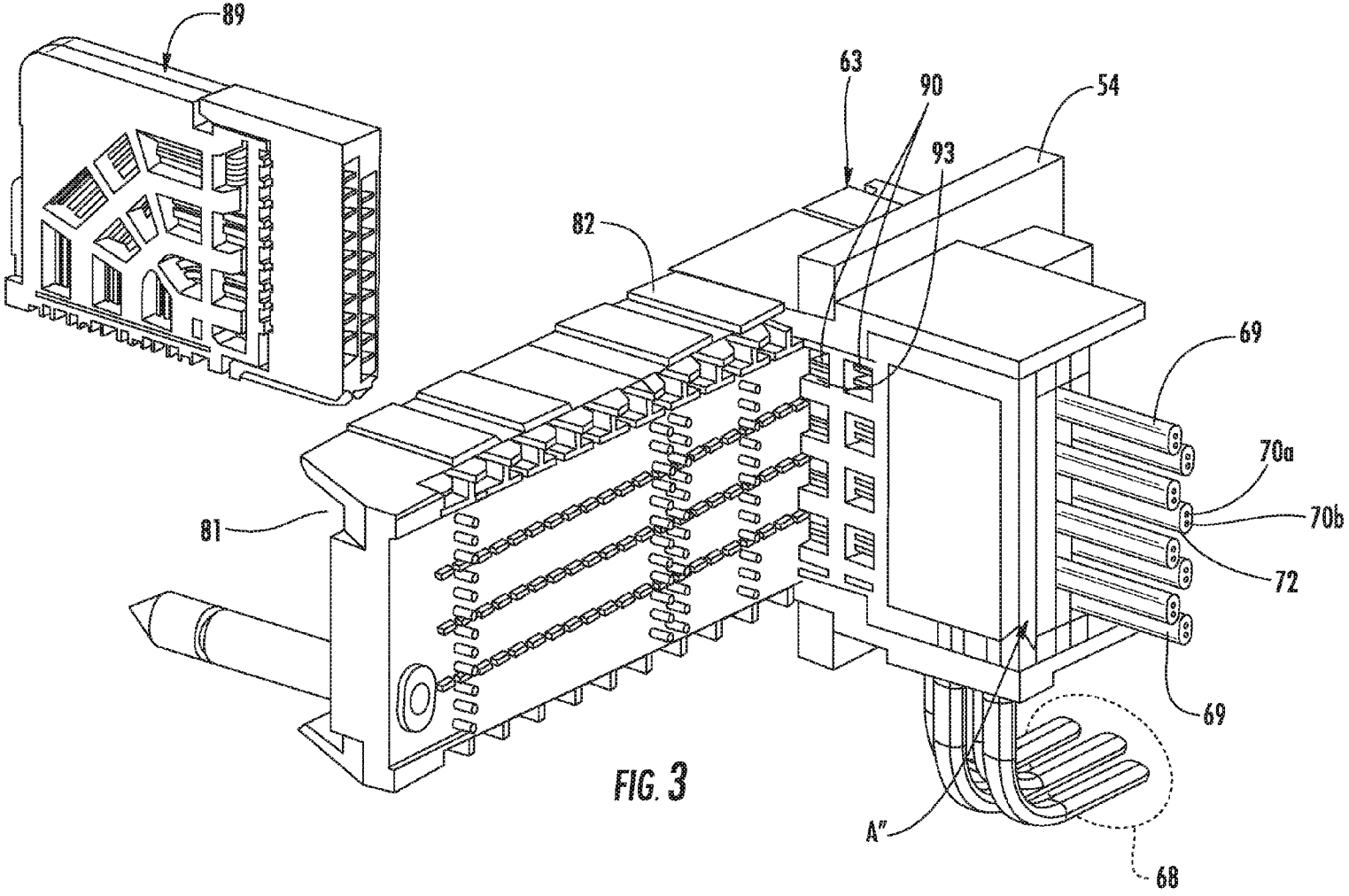
FIG. 3 is a perspective view, partially exploded, of a pin header utilized in the backplane system of FIG. 2, with a cable connector engaged therewith and a mating backplane connector disengaged and spaced apart therefrom.
Figure 4:
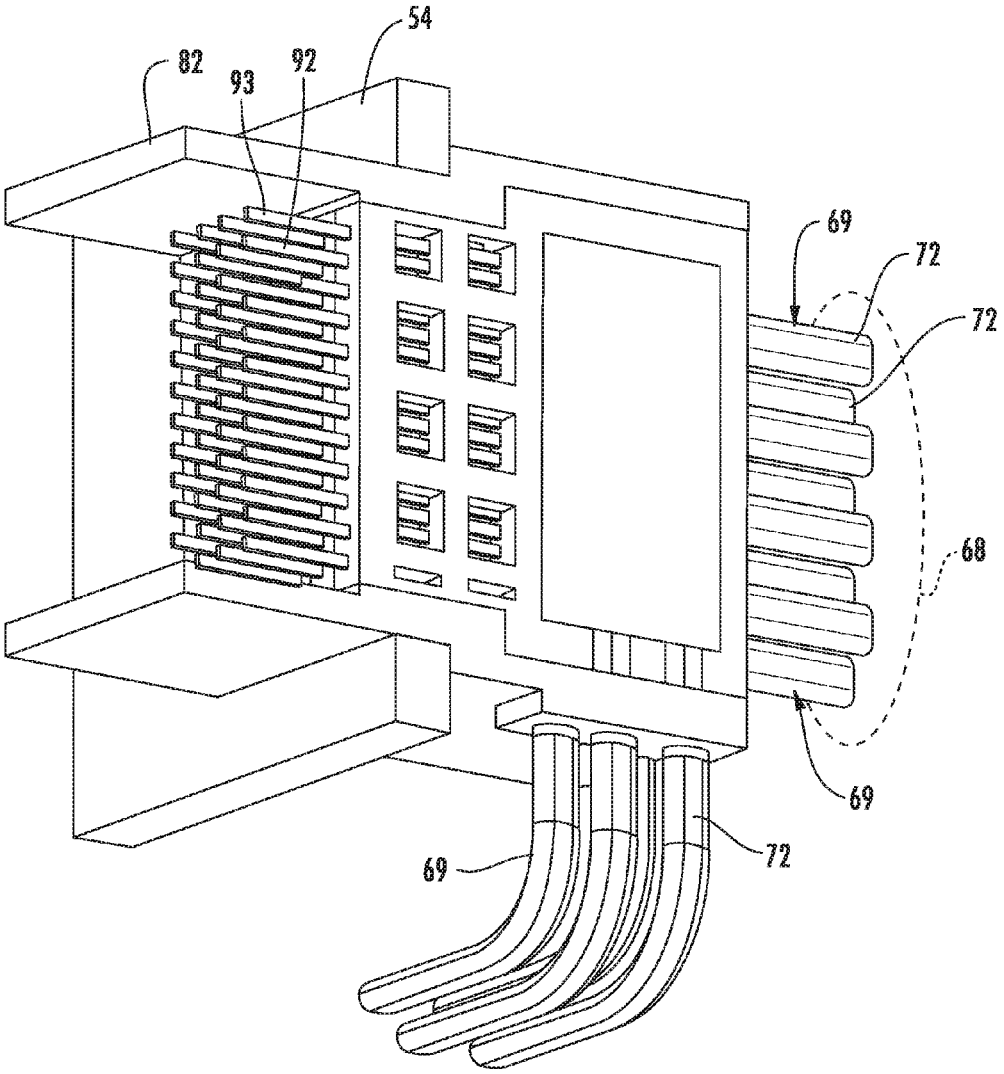
FIG. 4 is an enlarged view of the backplane cable connector of FIG. 2.
Figure 5:
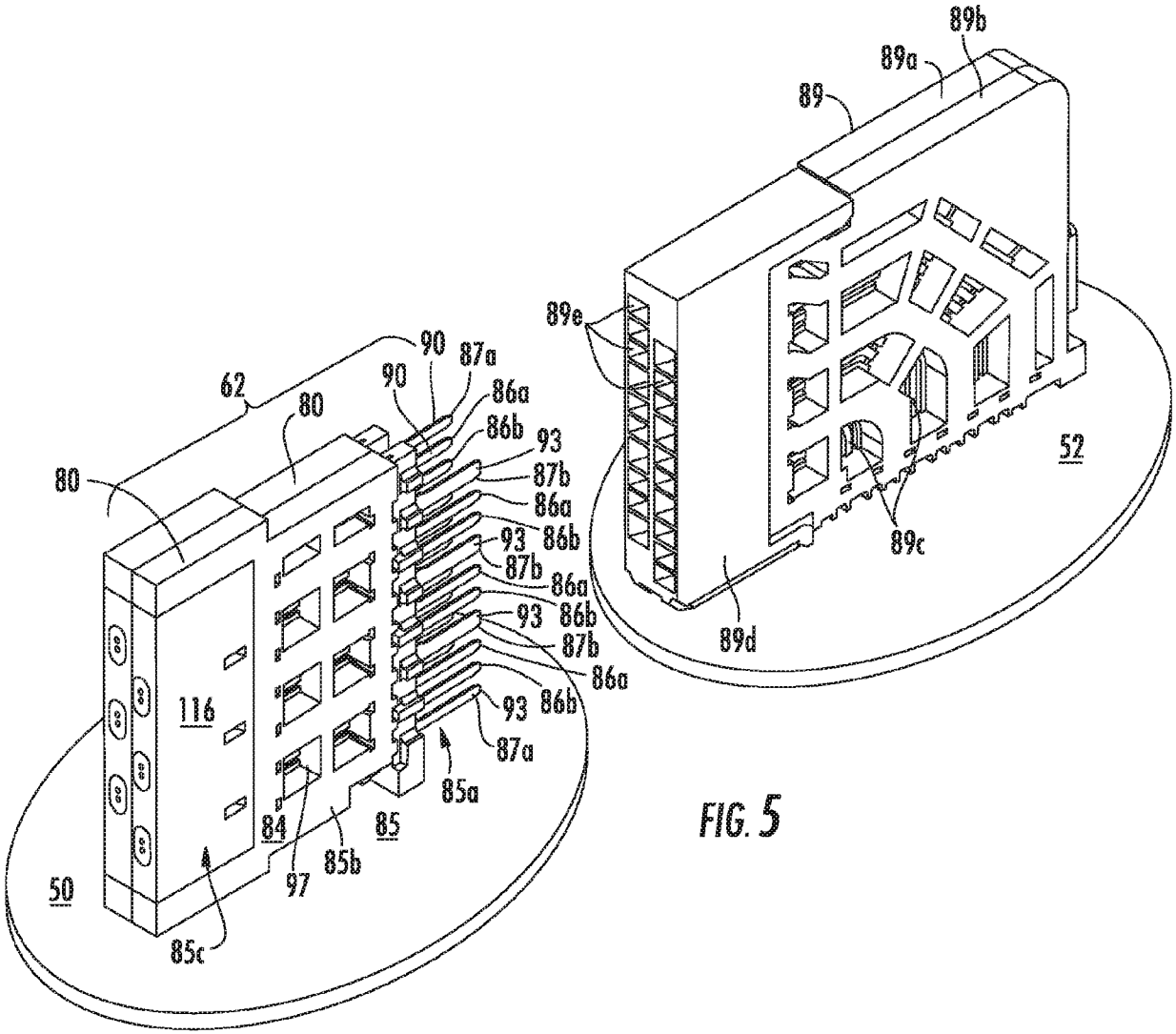
FIG. 5 is a perspective view of a backplane connector and a cable connector of the Present Disclosure.
Figure 6:
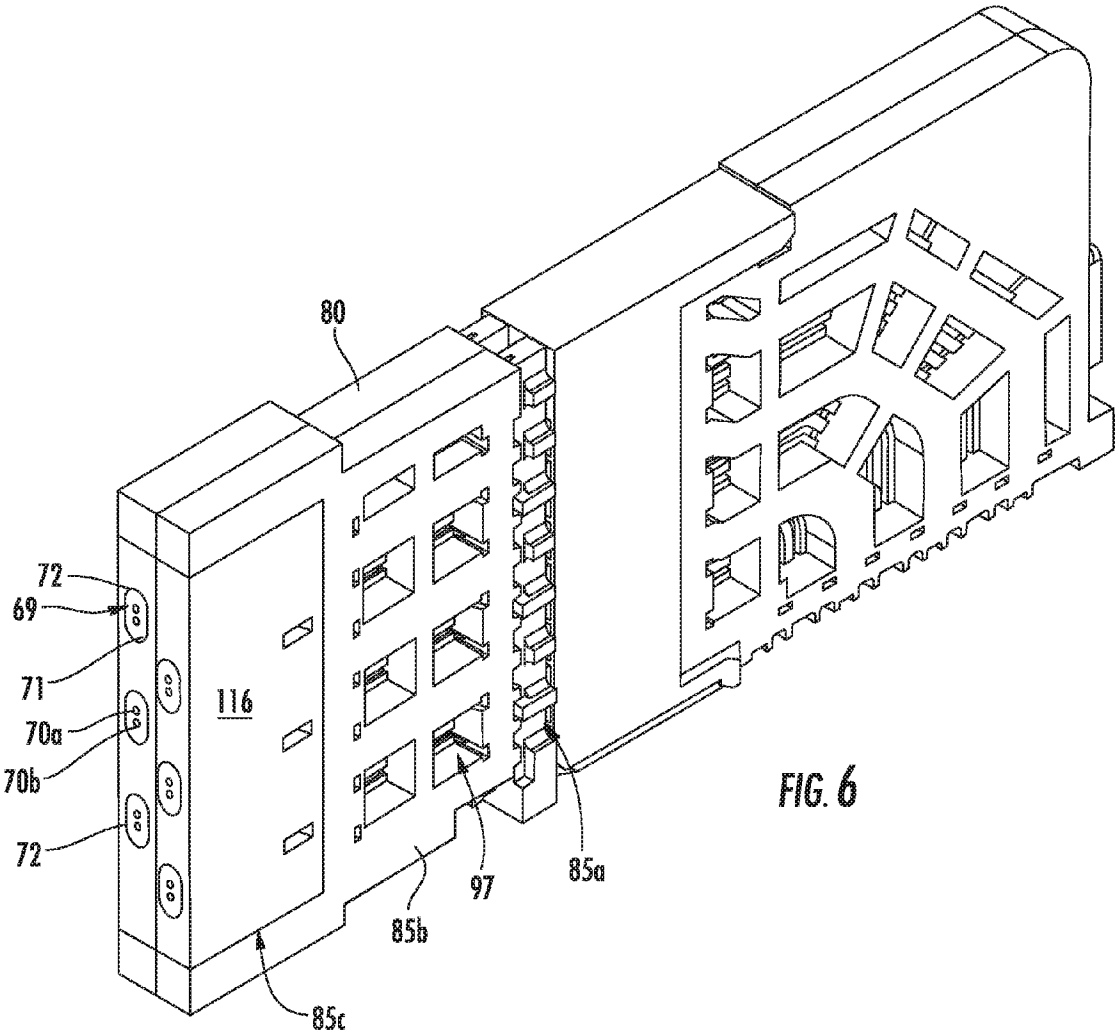
FIG. 6 is the same view as FIG. 5, but with the two connectors mated together.

FIGS. 5-12 depict one embodiment of a cable assembly and cable connector of the Present Disclosure, particularly suitable for mating the cable connector to a backplane style connector. It can be seen that the cable wires 69 are terminated to the cable connectors 62, and the cable connectors 62 are preferably formed from two halves, in the form of connector wafers 80, two of which are mated together in a suitable manner to form a connector. The wafers 80 are configured to mate in pairs with an opposing connector 63, such as the pin header 81 illustrated in FIG. 3, or a right angle connector 89 also be formed from two wafers 89*a-b* that support a plurality of conductive signal and ground terminals 89*c*. The terminals 89*c* terminate in mating ends that may take the form of cantilevered beams (not shown) that are held within an exterior shroud 89*d*, which contains a plurality of passages 89*e*. Each passage 89*e* is configured to receive one of the mating portions 90, 93 of the signal terminals 86*a-b* and the ground terminals 87*a-b* as shown in FIGS. 5-6. Such a connector arrangement shown in these Figures will be suitable for mating circuits on a primary circuit board 50 to those on a secondary circuit board 52. FIGS. 3-4 illustrate a connector arrangement that is suitable for use for connecting circuits through an intervening circuit board 54.

Figure 7:
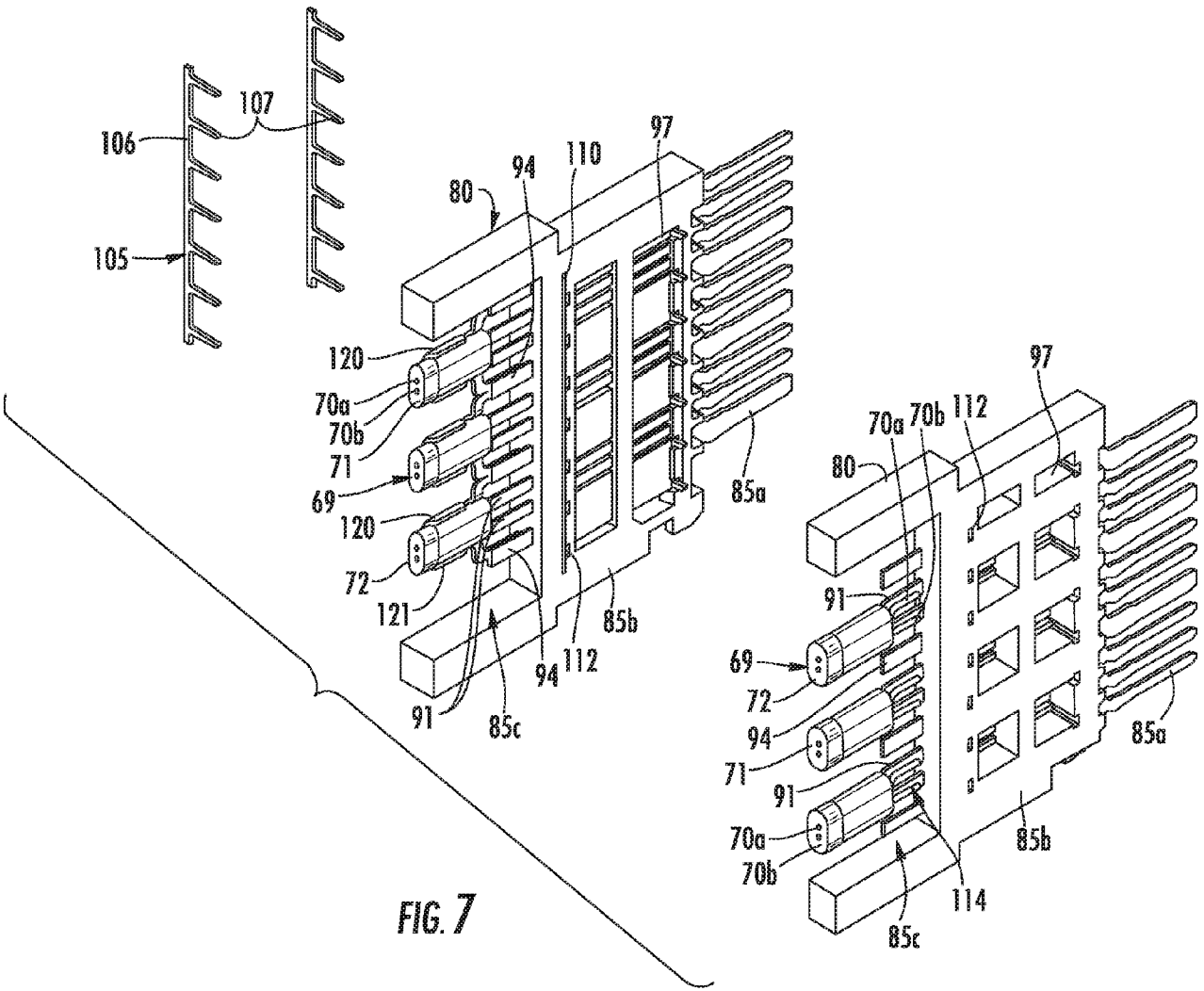
FIG. 7 is an exploded view of the cable connector of FIG. 5, with the two frame members separated from each other and with the overmolding removed to illustrate the cable wire termination area of the connector.
Figure 7A:
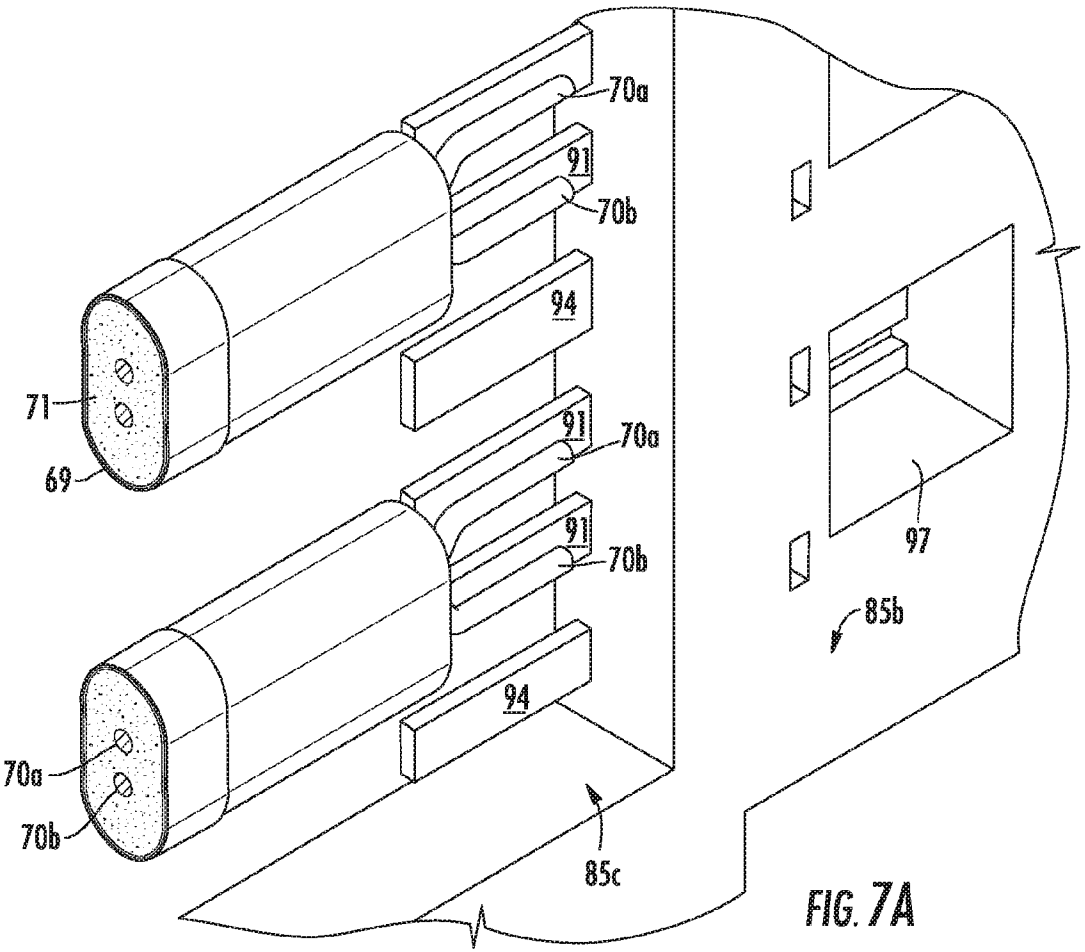
FIG. 7A is an enlarged detail view of the rightmost connector frame member of FIG. 7, illustrating the alignment of the connector terminal tails and the arrangement of the cable wire signal conductor free ends.
Figure 7B:
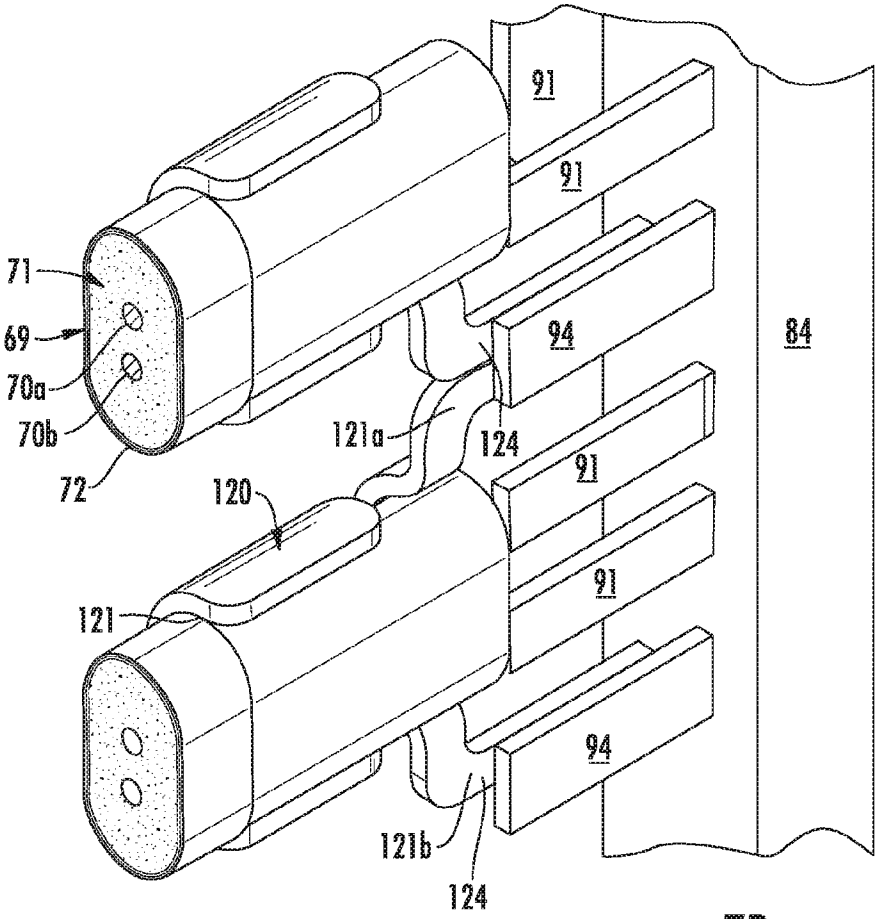
FIG. 7B is an enlarged detail view of the leftmost connector frame member of FIG. 7, illustrating the use of a ground shield cradle that permits termination of the cable wire grounding shield to two ground terminal tail portions flanking a pair of signal terminal tail portions of the connector.

The cable connector 62 of FIG. 5 may be used to mate with a right angle connector 89 as shown in FIG. 5 or may be used, with some modification, to mate directly with the pin header connector 81 of FIGS. 3-4. Turning to FIG. 7, each wafer 80 can be seen to have a frame member 84, preferably molded from an insulative material that provides a skeletal frame that supports both the cable wires 69 and the terminals of the cable connector 62. Each connector wafer 80 is preferably provided with distinct signal terminals 86 and ground terminals 87 that are arranged in a row upon the connector wafer 80. The signal terminals 86 in each row are themselves arranged in pairs of terminals 86*a-b* which are respectively connected to the cable wire signal conductors 70*a-b*. In order to maintain appropriate signal isolation and to further mirror the geometry of the cable wires 68, the pairs of signal terminals 86*a*, 86*b* are preferably flanked by one or more of the ground terminals 87, within each row of each connector wafer 80. The frame member 84, as illustrated, also may have a plurality of openings 97 formed therein that expose portions of the signal and ground terminals 86*a-b* & 87*a-b* to air for coupling between terminals of connected wafers 80 and for impedance control purposes. These openings 97 are elongated and extend vertically along the interior faces of the connector wafers 80 (FIG. 8), and are separated into discrete openings by portions of the frame 84 along the exterior faces of the connector wafers 80. They provide an intervening space filled with an air dielectric between terminals within a connector wafer pair as well as between adjacent connector wafer pairs.

The arrangement of the terminals of the wafers 80 is similar to that maintained in the cable wires 69. The signal terminals 86*a-b* are set at a desired spacing and each such pair of signal terminals, as noted above, has a ground terminal 87 flanking it. To the extent possible, it is preferred that the spacing between adjacent signal terminals 86*a-b* is equal to about the same spacing as occurs between the signal conductors 70*a-b* of the cable wires 69 and no greater than about two to about two and one-half times such spacing. That is, if the spacing between the signal conductors 70*a-b* is L, then the spacing between the pairs of the connector signal terminals 86*a,b* (shown vertically in the Figures) should be chosen from the range of about L to about 2.5 L This is to provide tail portions that may accommodate the signal conductors of each wire 69 in the spacing L found in the wire. Turning to FIG. 10C, it can be seen that each signal terminal 86*a,b* has a mating portion 90, a tail portion 91 and a body portion 92 that interconnects the two portions 90, 91 together. Likewise, each ground terminal includes a mating portion 93, a tail portion 94 and a body portion 95 interconnecting the mating and tail portions 93, 94 together.

The terminals within each connector wafer 80 are arranged, as illustrated, in a pattern of G-S-S-G-S-S-G-S-

Figure 7C:
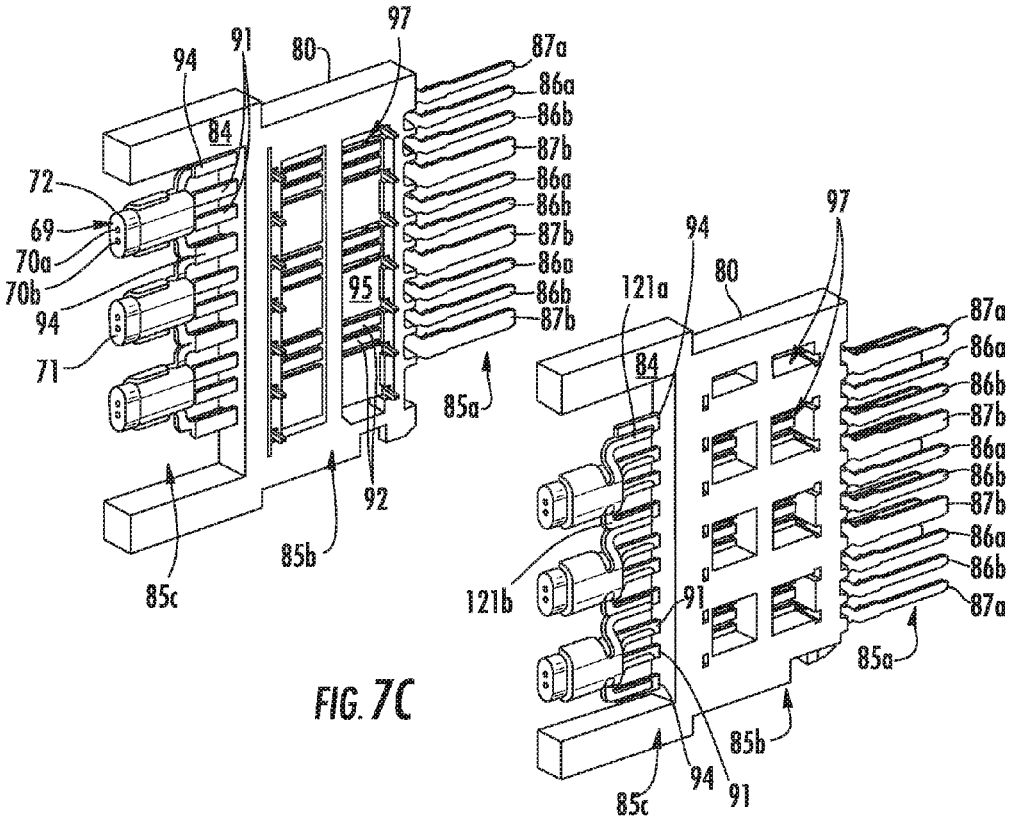
FIG. 7C is the same view as FIG. 7, but with the commoning members in place on the leftmost connector frame member.
Figure 7D:
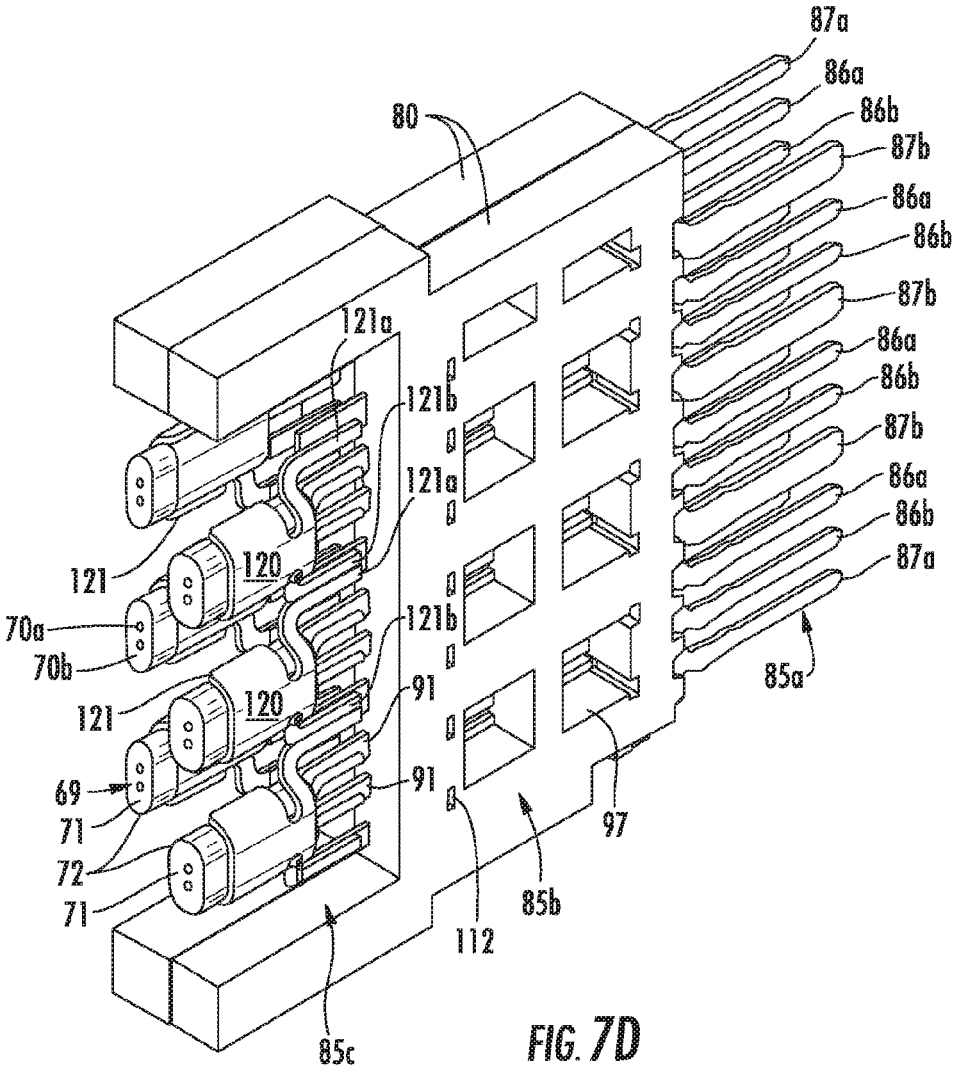
FIG. 7D is the same view as FIG. 7, but with the connector frame members joined together.
Figure 8:
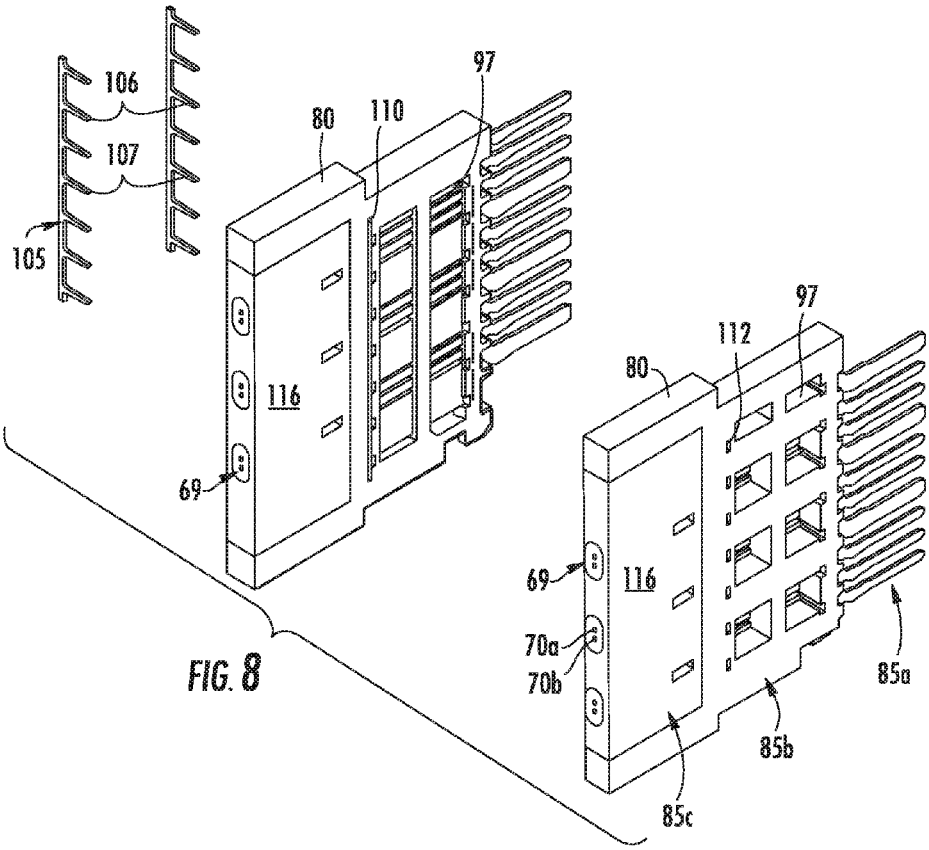
FIG. 8 is the same view as FIG. 7, but with the termination area of the connector frame members filled in with a plastic or other suitable material.
Figure 8A:
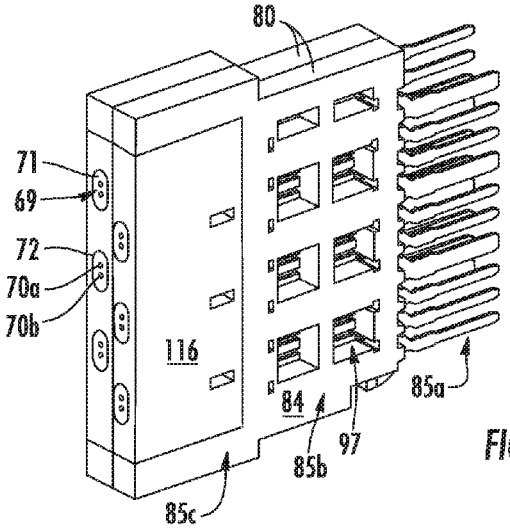
FIG. 8A is the same view as FIG. 7, but with the connector fame members joined together, the commoning members inserted and with the termination areas overmolded.

S-G, where "S" refers to a signal terminal 86*a*, 86*b* and "G" refers to a ground terminal 87*a*, 87*b*. This is a pattern shown in the Figures for a wafer 80 that accommodates three pairs of twin-ax wires in a single row. This pattern will be consistent among wafers 80 with a greater or lesser number of twin-ax wire pairs. In order to achieve better signal isolation, each pair of signal terminals 86*a*, 86*b* are separated from adjacent signal terminal pairs other by intervening ground terminals 87*a*, 87*b*. Within the vertical rows of each connector wafer 80, the ground terminals 87*a-b* are arranged to flank each pair of signal terminals 86*a-b*. The ground terminals 87*a-b* also are arranged transversely to oppose a pair of signal terminals 86*a-b* in an adjacent connector wafer 80. (FIG. 7C.)

The ground terminals 87*a*, 87*b* of each wafer 80 may be of two distinct types. The first such ground terminal 87*a*, is found at the end of an array, shown at the top of the terminal row of FIG. 10C and may be referred to herein as "outer" or "exterior" ground terminal as it are disposed in the connector wafer 80 at the end(s) of a vertical terminal row. These terminals 87*a* alternate being located at the top and bottom of the terminal arrays in adjacent connector wafers 80 as the terminal rows are offset from each other as between adjacent connector wafers. The second type of ground terminal 87*b* is found between pairs of signal terminals, and not at the ends of the terminal arrays, and hence are referred to herein as "inner" or "interior" ground terminals 87*b*.

In this regard, the difference between the two ground terminals 87*a*, 87*b* is that the "inner" ground terminals 87*b* have wider tail, body and mating portions. Specifically, it is preferred that the body portions of the inner ground terminals 87*b* be wider than the body portions of the outer ground terminals 87*a* and substantially wider (or larger) than the body portions 92 of the corresponding pair of signal terminals 86*a-b* which the inner ground terminals 87*b* oppose, i.e., those in a signal terminal pair in an adjacent wafer. The terminals in the rows of each connector wafer 80 differ among connector wafers so that when two connector wafers are assembled together as in FIG. 5, the wide ground terminals 87*b* in one connector wafer row of terminals flank, or oppose, a pair of signal terminals 86*a-b*. This structure provides good signal isolation of the signal terminals in each signal terminal pair. If one were to view a stack of connector wafers from their collective mating end, one would readily see this isolation. This reduces crosstalk between the signal terminals of one pair and other signal terminal pairs.

The second ground terminals 87*b* preferably include openings, or windows 98, 99 disposed in their body portions 95 that serve to facilitate the anchoring of the terminals to the connector frame body portion 85*b*. The openings 98, 99 permit the flow of plastic through and around the ground terminals 87*a-b* during the insert molding of the connectors. Similarly, a plurality of notches 100, 102 are provided in the edges of the signal terminal body portions 92 and the body portions 95 of ground terminals opposing them. These notches 100, 102 are arranged in pairs so that they cooperatively form openings between adjacent terminals 86*a*, 86*b* that are larger than the terminal spacing. These openings 100, 102 similar to the openings 98, 99, permit the flow of plastic during insert molding around and through the terminals so that the outer ground terminals 87*b* and signal terminals 86*a,b* are anchored in place within the connector wafer 80. The openings 98, 99 and notches 100, 102 are aligned with each other vertically as shown in FIG. 10C.

Figure 9:
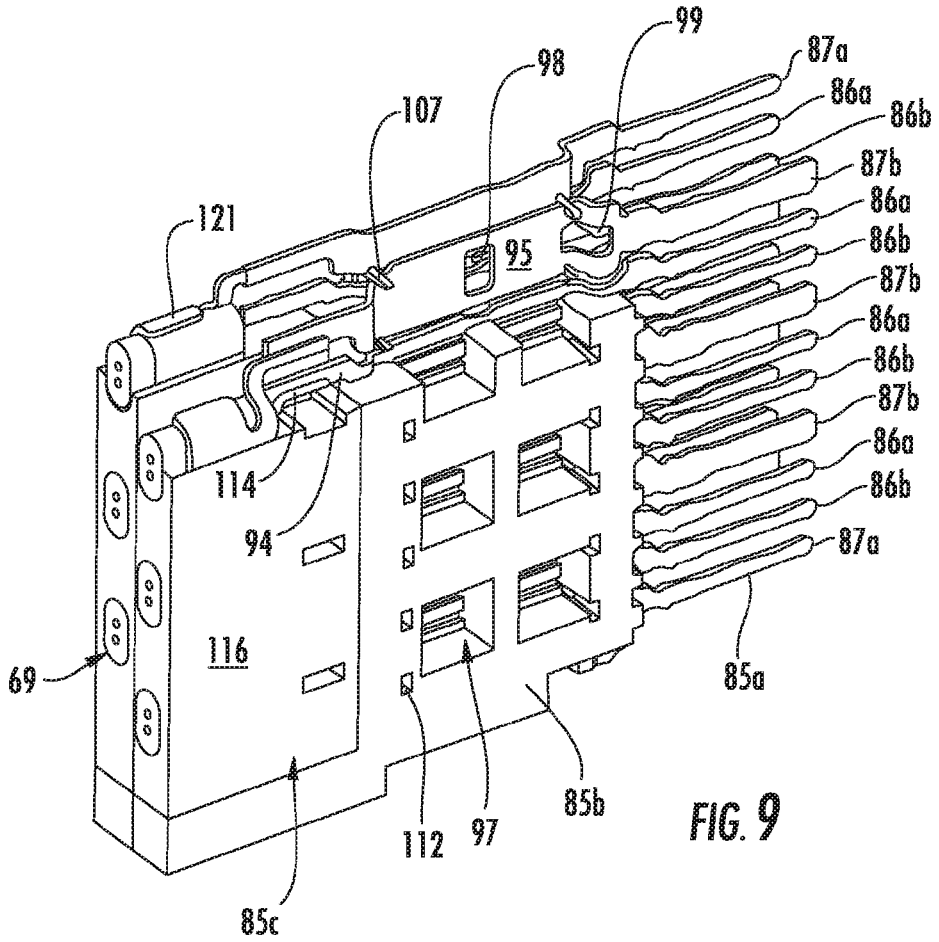
FIG. 9 is a perspective view of the two connector frame members of FIG. 7, brought together as a single connector and with the top portion thereof removed to illustrate the engagement of the commoning member with the two types of ground terminals and illustrating how the terminals are spaced apart from each other within the connector.
Figure 9A:
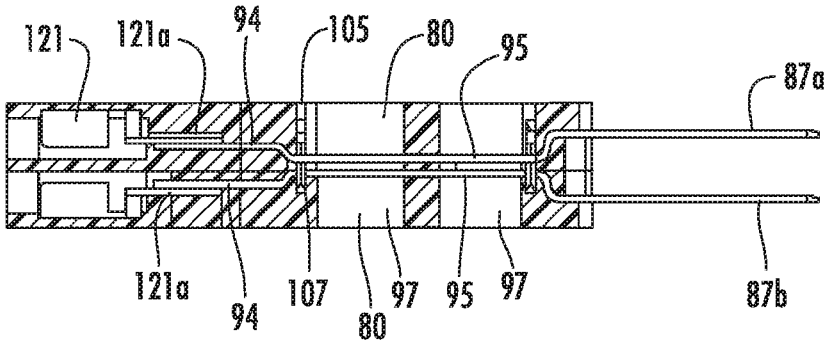
FIG. 9A is a top plan view of the single connector of FIG. 9.

In order to provide additional signal isolation, the wafers 80 may further includes one or more commoning members 104 (FIGS. 7-9) that take the form or bars, or combs 105, with each such member having an elongated backbone portions 106 and a plurality of tines, or contact arms, 107 that extend outwardly therefrom at an angle thereto. The combs 105 are received within channels 110 that are formed in the wafers 80, and preferably along a vertical extent thereof. The tines 107 are received in passages 112 that extend transversely through the connector wafers so that they may contact the ground terminals 87*a-b*. As shown in FIG. 10D, the tines 107 extend through the two mated connector wafers 80 and contact both of the ground terminals on the left and right sides of the pair of connector wafers 80, which further increases the isolation of the signal terminals 86*a-b* (FIG. 9).

In furtherance of maintaining the geometry of the cable wires 68, the outer insulation 71 and grounding shield 72 covering each twin-ax wire 69 are cut off and peeled back, to expose free ends 114 of the signal conductors 70*a-b*. These conductor free ends 114 are attached to the flat surfaces of the signal terminal tail portions 91. The grounding shield 72 of each twin-ax wire 69 is connected to the ground terminals 87*a-b* by means of a grounding cradle 120. The cradle 120 has what may be considered a cup, or nest, portion, 121 that is formed in a configuration generally complementary to the exterior configuration of the cable wire 69, and it is provided with a pair of contact arms 122*a-b* which extend outwardly and which are configured for contacting opposing, associated ground terminal tail portions 94 of the connector wafers 80.

The two contact arms 122*a-b* are formed along the outer edges of the cup portion 121 so that contact surfaces 124 formed on the contact arms 122*a-b* are preferably aligned with each other along a common plane so that they will easily engage opposing surfaces of the ground terminal tail portions for attachment by welding or the like. The grounding cradles 120 may also be formed as a ganged unit, where a certain number of cradles 120 are provided and they are all interconnected along the contact arms 122*a-b* thereof. The cup portions 121 are generally U-shaped and the U is aligned with the pair of signal terminal tail portions so that the signal terminal tail portions would be contained within the U if the cup portion 121 were extended or vice-versa. In this manner, the geometry of the twin-ax wires is substantially maintained through the termination of the cable wires 69 with minimal disruption leading to lessened impedance discontinuities. Thus, the high speed signals of the chip set 56 are removed from passage directly on the circuit boards 50, 52, and the use of vias for the board connectors is eliminated. This not only leads to a reduction in cost of formation and manufacture of the circuit board, but also provides substantially complete shielding at the connection with the cable connector without any excessive impedance discontinuity.

Figure 10A:
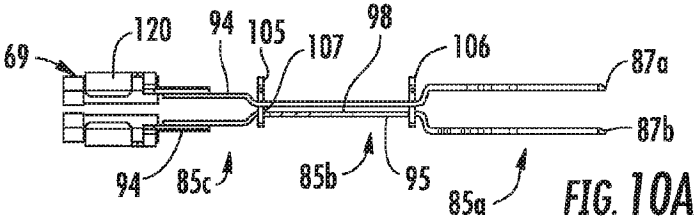
FIG. 10A is a top plan view of the terminal sets of FIG. 10.
Figure 10B:
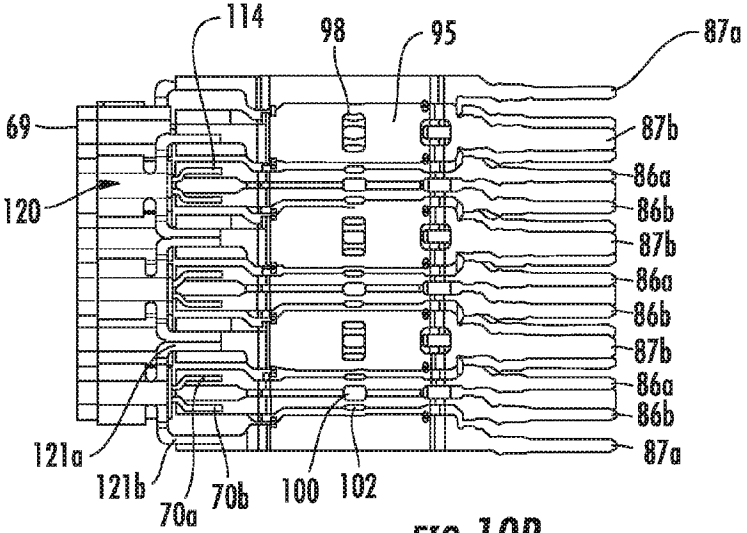
FIG. 10B is a side elevational view of the terminal sets of FIG. 8A.
Figure 10:
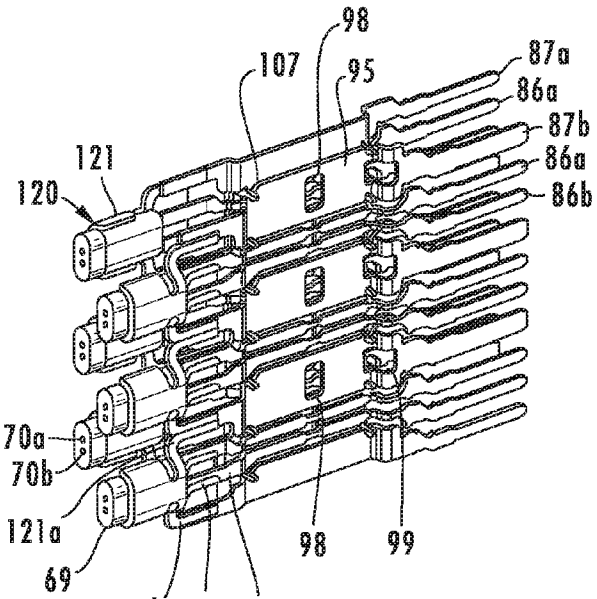
FIG. 10 is a perspective view of the two terminal sets utilized in the connector of FIG. 8A, with the connector frame member removed for clarity.
Figure 10C:
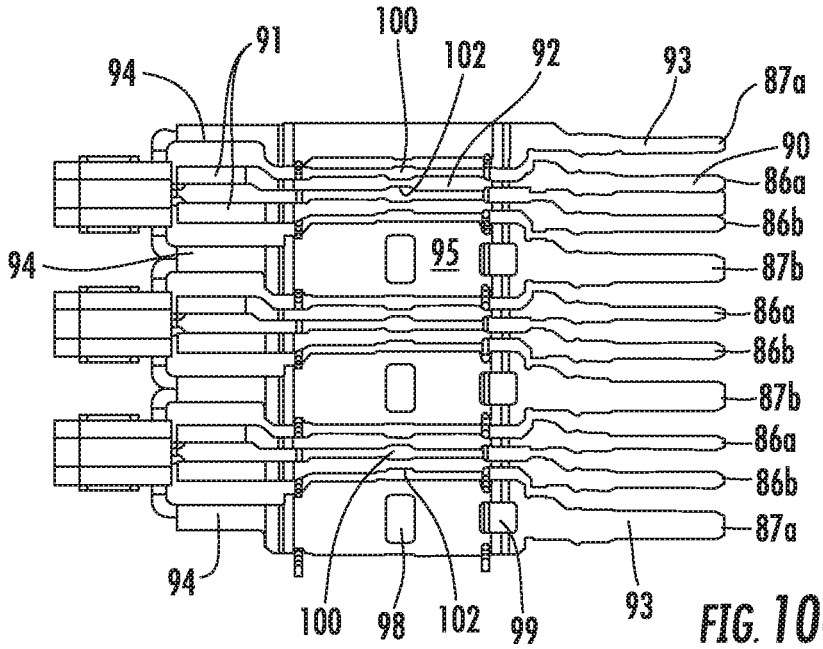
FIG. 10C is a side elevational view of the leftmost terminal set of FIG. 10.
Figure 10D:
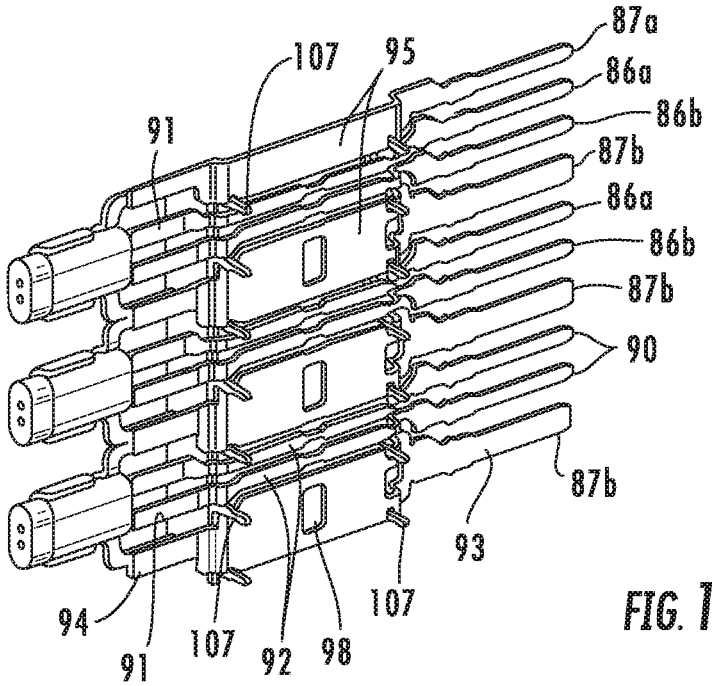
FIG. 10D is the same view as FIG. 10, but with the rightmost terminal set removed for clarity.
Figure 11:
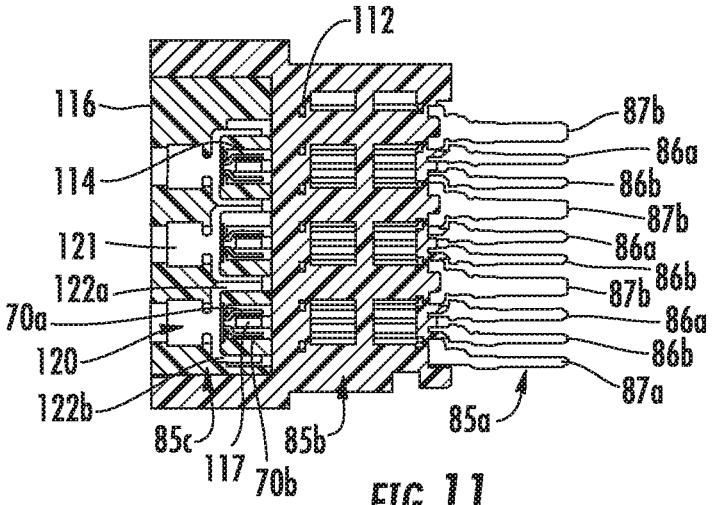
FIG. 11 is a partial sectional view of the rightmost connector frame member of FIG. 7C, taken along the level of the terminal tail and mating blade portions thereof, with the termination area filled with an overmolding material.
Figure 12:
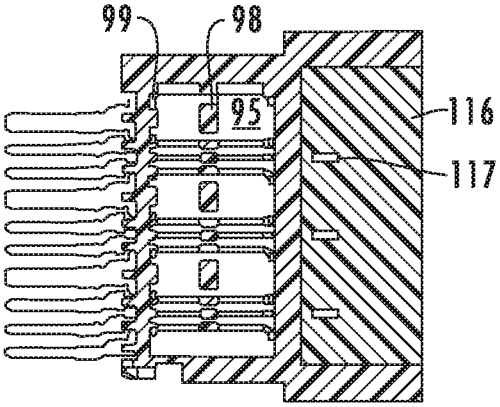
FIG. 12 is a partial sectional view of the rightmost connector frame member of FIG. 7C, taken from the far side thereof and taken along the level of the terminal body portions.

As shown in FIG. 10A, the spacing between the connector wafer terminal tail portions of adjacent connector wafers is first at a predetermined spacing, then the spacing lessens where the terminal body portions are held in the connector frame and then the spacing increases at the terminal mating portions to a spacing that is greater than the predetermined spacing. The reduction in spacing along the terminal body portions takes into account the effect of the wider body portions of the ground terminals 87*b* and thus the spacing between the connector wafers in a pair of connector wafers varies in order to lessen any impedance discontinuities that arise. FIG. 10B illustrates how the wider ground terminal 87*b* in one vertical array are vertically offset from the other ground terminal 87*a* in the other, adjacent terminal array. This offset arrangement can also be determined from the order of the terminal-receiving passages 89*e* of the opposing mating connector 89 of FIG. 5. The connector wafer termination area 85*c* is preferably overmolded with a plastic 116 so as to cover the welds or solder used to attach the cable wire free ends 114 to their respective terminal tail portions and seal the termination area. Additional windows 117 may be formed in this overmolded portion to provide an air-filled passage between the signal terminal tail portions and the wire conductors 70*a-b* of each cable wire pair.

The connector wafers 80 discussed above may also be used in a manner as illustrated in FIGS. 3-4, where the terminal mating portions extend through the body of a backplane connector such as the pin header shown and into a channel defined between two sidewalls on the other side of an intervening circuit board 54. An opposing, mating right angle connector 89 similar to that shown in FIG. 5 is provided to fit into the space between the connector sidewalls 82 in order to effect a connection at a right angle to the intervening circuit board 54. In this embodiment, the terminal mating portions 90, 93 may take the form of flat mating blades or pins. The cable wires 69 associated with some of the connector wafers are in line with the terminal mating portions, but there may be instances where it is desired to have the cable wires 69 attached to the connector wafers in an angled fashion.

Figure 13:
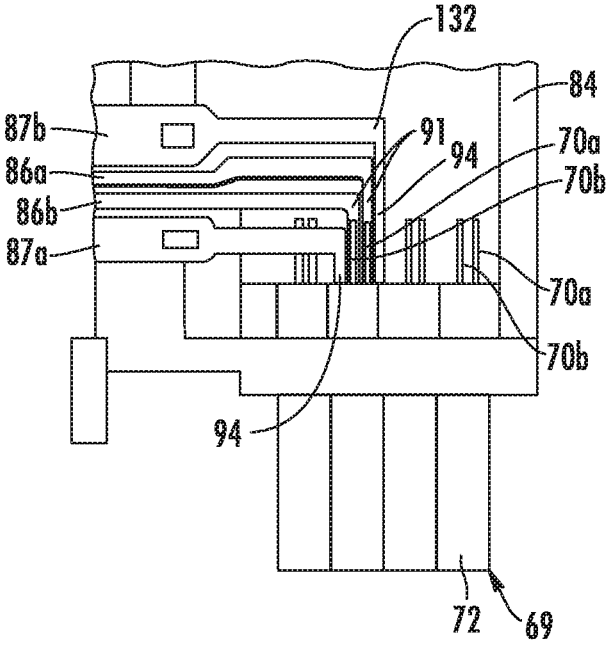
FIG. 13 is a view illustrating, in detail, area "A" of FIG. 3, which illustrates an angled cable connector constructed in accordance with the principles of the Present Disclosure mated with a backplane connector of the pin header style.

A pair of such right angle connector wafers 130 are shown as part of the group of connector wafers illustrated in FIGS. 3-4. The use of a right angle exit point from the connector wafer frees up some space at the rear ends of the group of connector wafers. FIG. 13 illustrates a partial sectional view of such a connector wafer 130. The terminals of the connector are formed with bends 132 in them so that the signal terminal tail portions 91 and ground terminal tail portions 94 are aligned with the entry point of the twin-ax wires 69 into the connector wafer frame 84. Ground cradles such as those described above are used to make contact with the outer conductive shielding 72 of the wires and utilize contact arms to attach to the ground terminal tail portions 94. In such an arrangement, the ground cradles are better being used in a ganged fashion.

Figure 14:
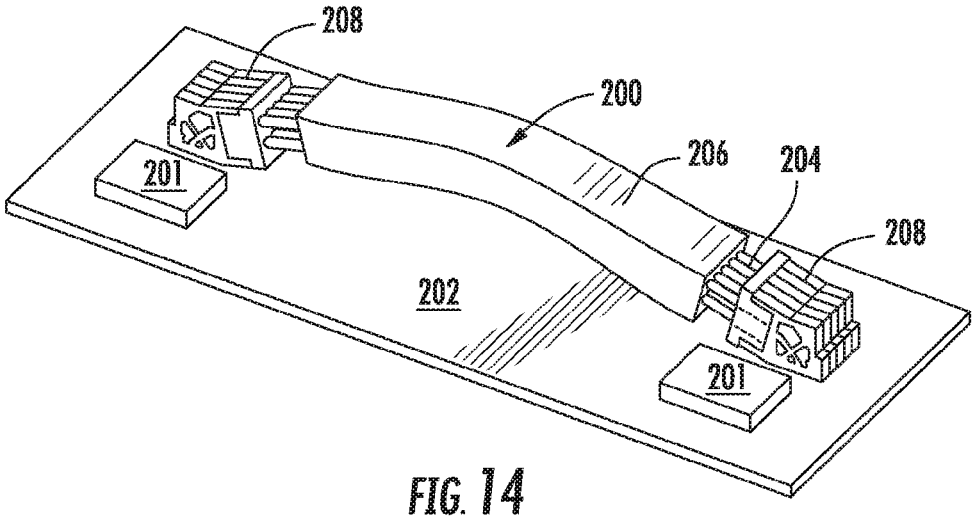
FIG. 14 is a perspective view of a circuit board utilizing another embodiment of a bypass cable assembly constructed in accordance with the principles of the present disclosure and suitable for interconnecting together two backplanes connectors mounted on the circuit board.
Figure 15:
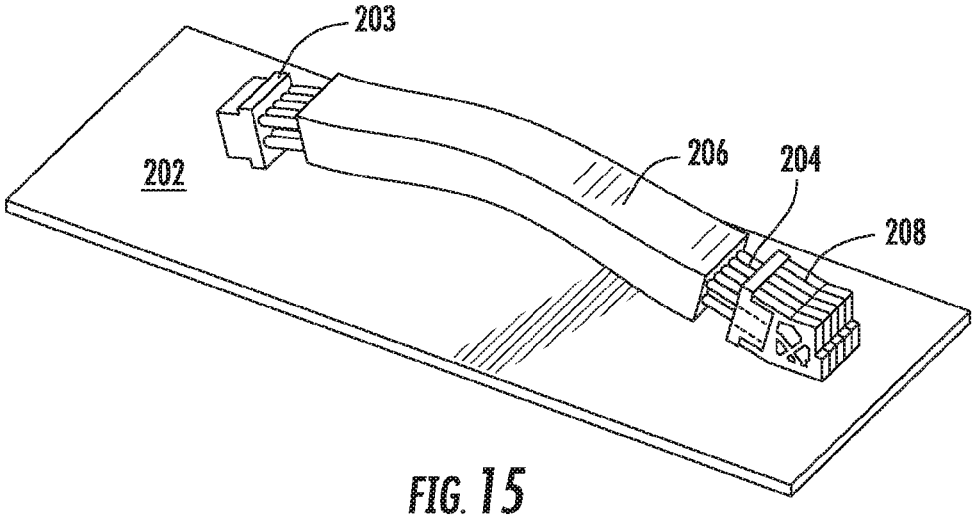
FIG. 15 is a perspective view of a circuit board utilizing a third embodiment of a bypass cable assembly constructed in accordance with the present disclosure and suitable for interconnecting circuits of the circuit board to a backplane connector.
Figure 18:
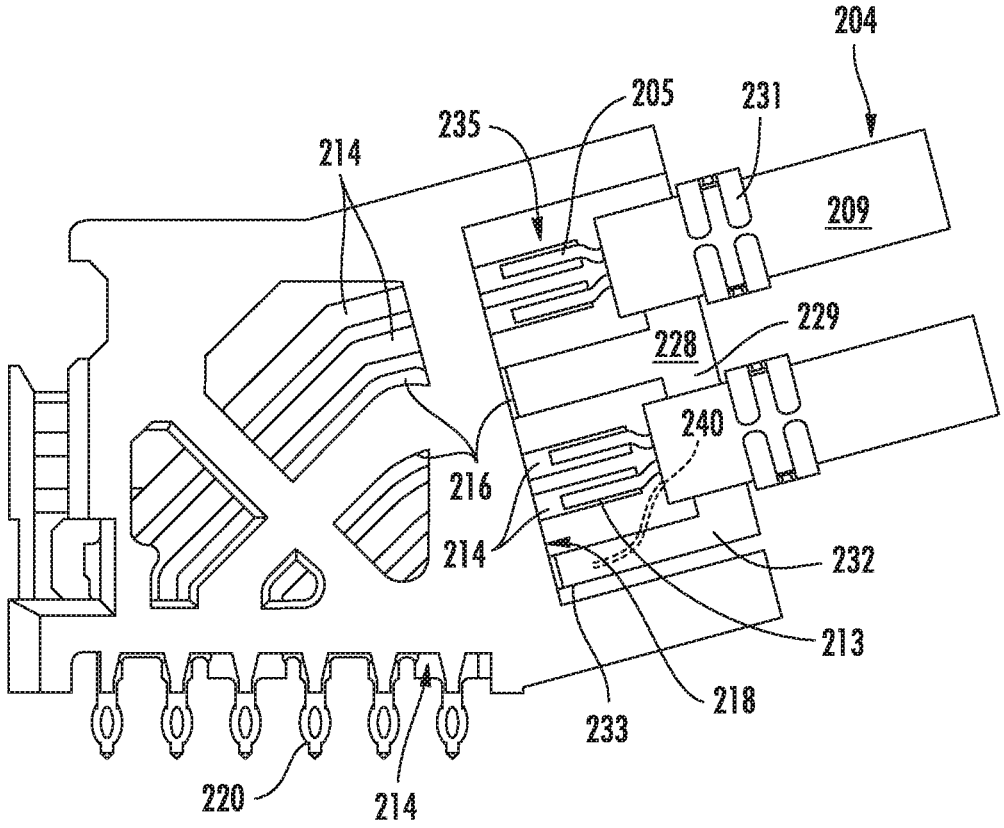
FIG. 18 is an elevational view of the far side of the rightmost wafer connector half of FIG. 16C.
Figure 18A:
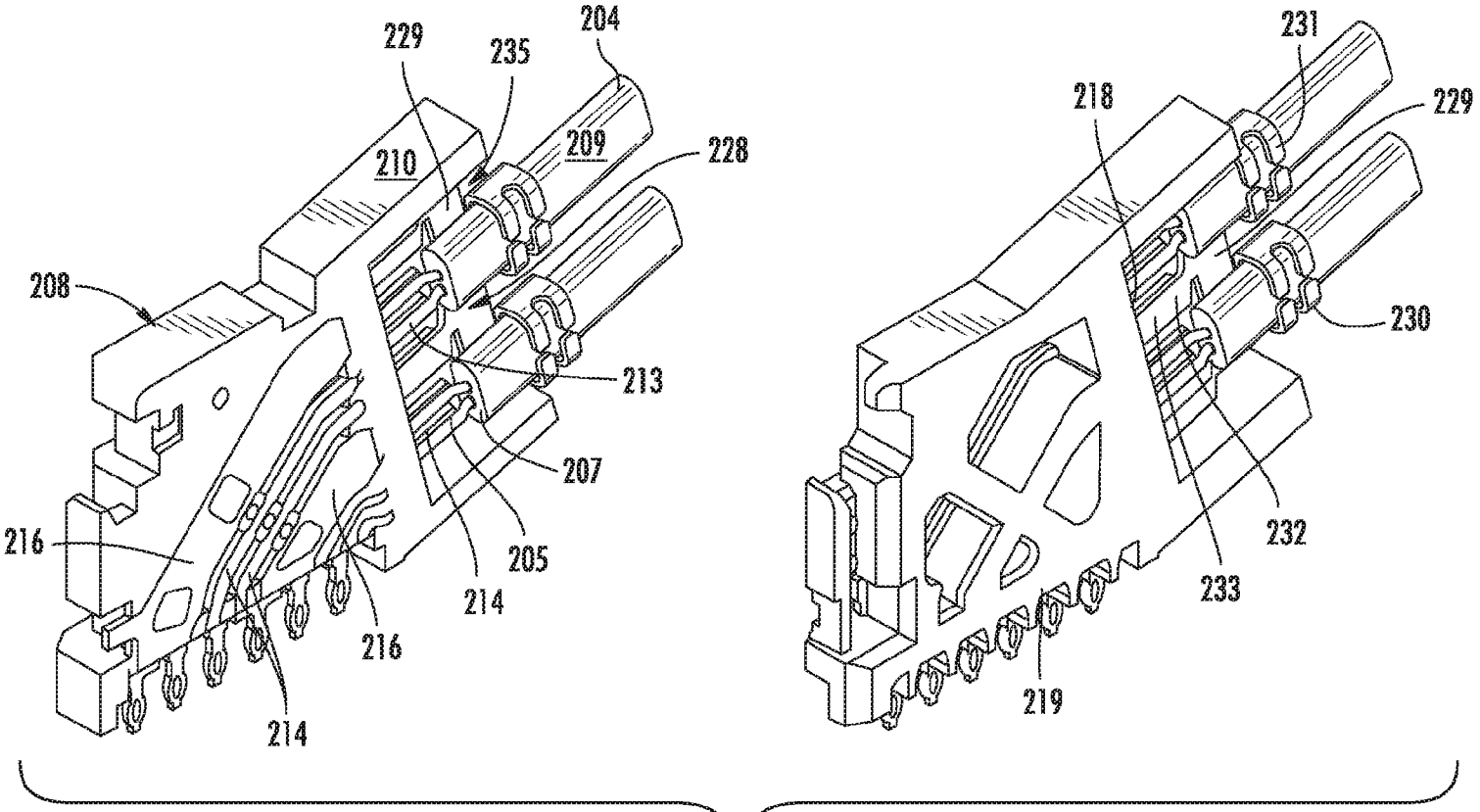
FIG. 18A is a perspective view, taken from the other side of the wafer connector of FIG. 16C.
Figure 18B:
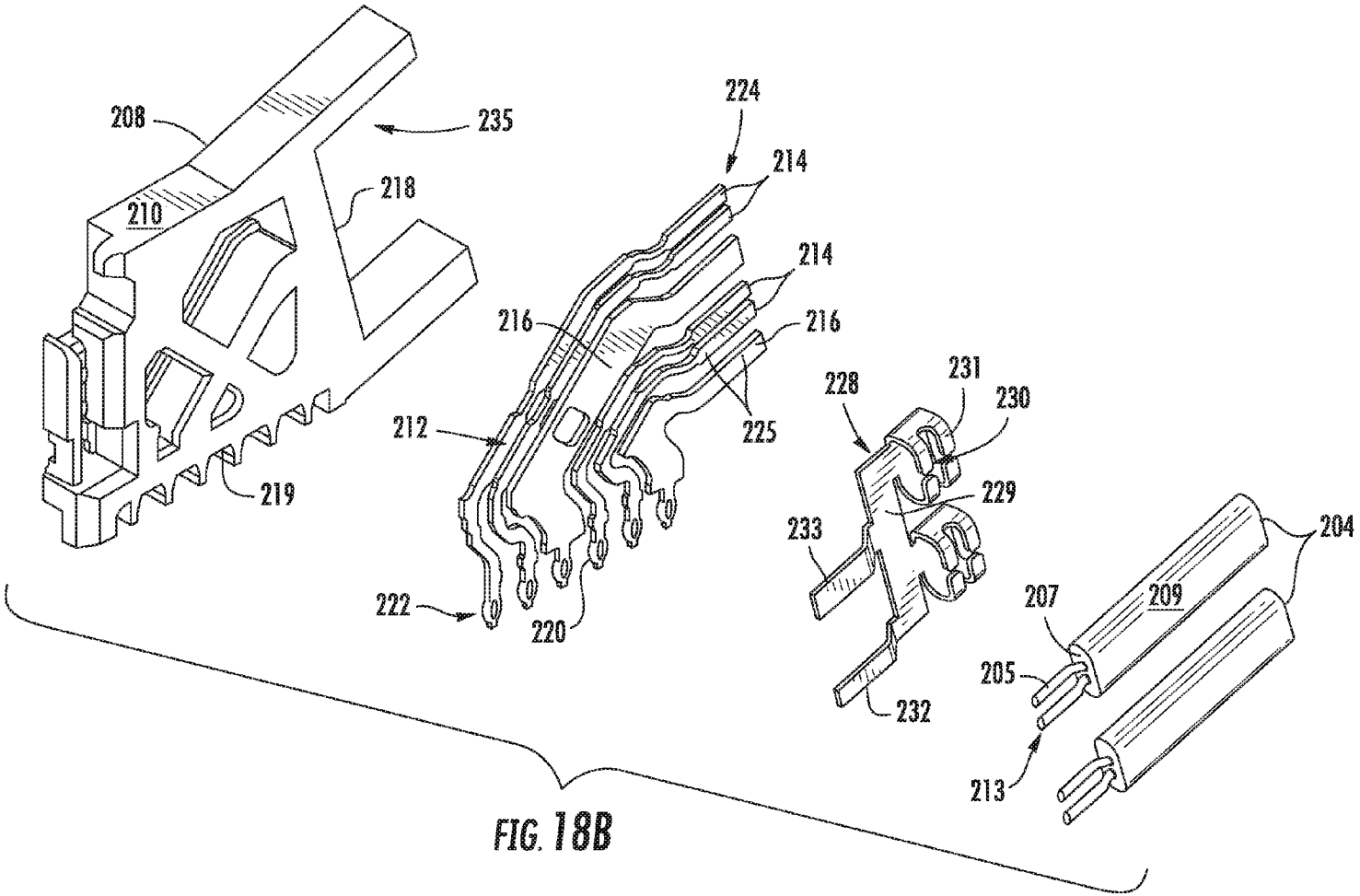
FIG. 18B is an exploded view of the nearmost wafer connector half of FIG. 18A.
Figure 19A:
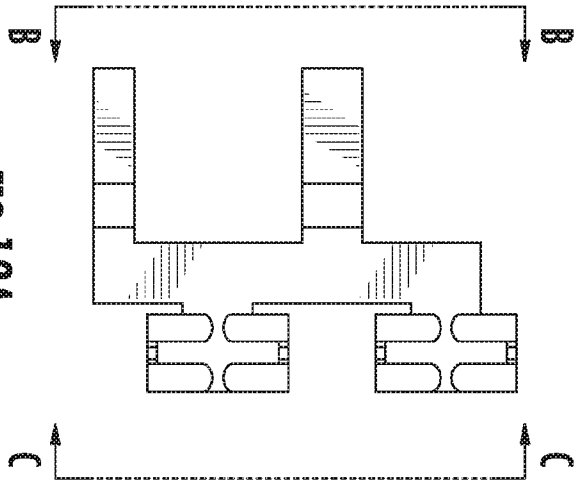
FIG. 19A is a top plan view of the grounding member of the connector assembly of FIGS. 16C and 18A.
Figure 19B:
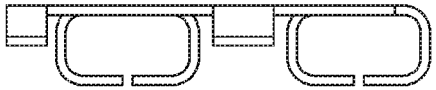
FIG. 19B is an end elevational view taken along lines B-B of FIG. 19A.
Figure 19C:
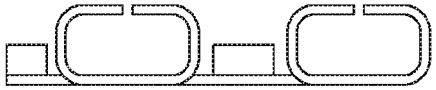
FIG. 19C is an elevational view of the other end of the grounding member of FIG. 19A, taken along lines C-C thereof.
Figure 19D:
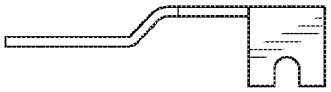
FIG. 19D is a side elevational view of the grounding member of FIG. 19A.

FIG. 14 illustrates the use of a cable bypass assembly 200 to provide a point-to-point connection on a circuit board 202 for high speed and high frequency signal transmission. In this embodiment, a plurality of twin-ax wires 204 enclosed in a cable 206 are directly connected to two fixed interconnects in the form of wafer connectors 208 mounted to the circuit board 202 in order to bypass the lossy material of the circuit board 202. The twin-ax wires 204 each contain a pair of signal conductors 205 that extend lengthwise through each wire 204 and which are surrounded by a dielectric material 207. Each wire 204 is typically also surrounded by an outer ground shield, in the form of a conductive foil wrapping or the like. The cable wires 204 may be drainless, or as best illustrated in FIG. 18, they may contain an additional drain wire 240. Although two connectors 208 are shown at the ends of the cable assembly 200, the ends of the cable 206 may be terminated to other components such as those mentioned above, including chips 201 and the like as well as designated termination areas 203 on the circuit board 202 as illustrated in FIG. 15. As illustrated in FIG. 14, the cable assembly 200 may be used to provide a transmission line between two chips 201 by way of connections to the circuit board 202.

Figure 16:
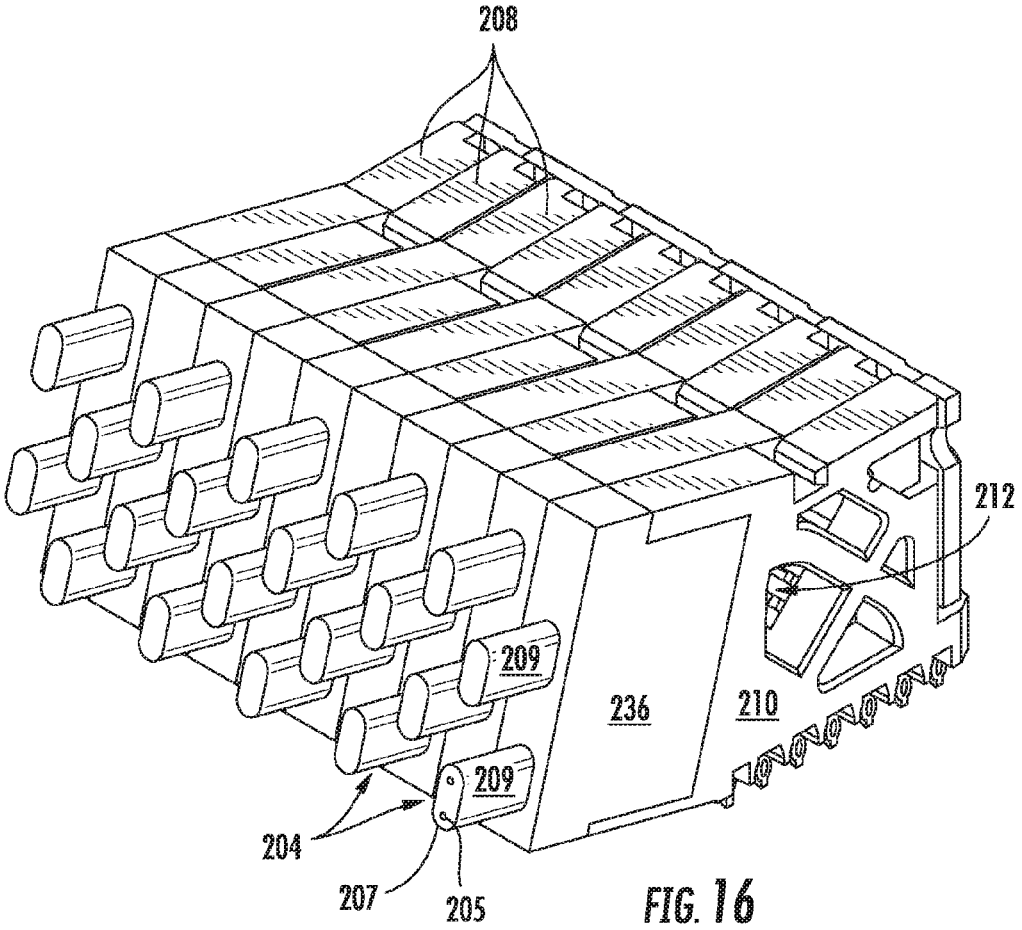
FIG. 16 is a perspective view of a stack of connector wafers to which cables are connected as in the cable assemblies of FIGS. 14 and 15.
Figure 16A:
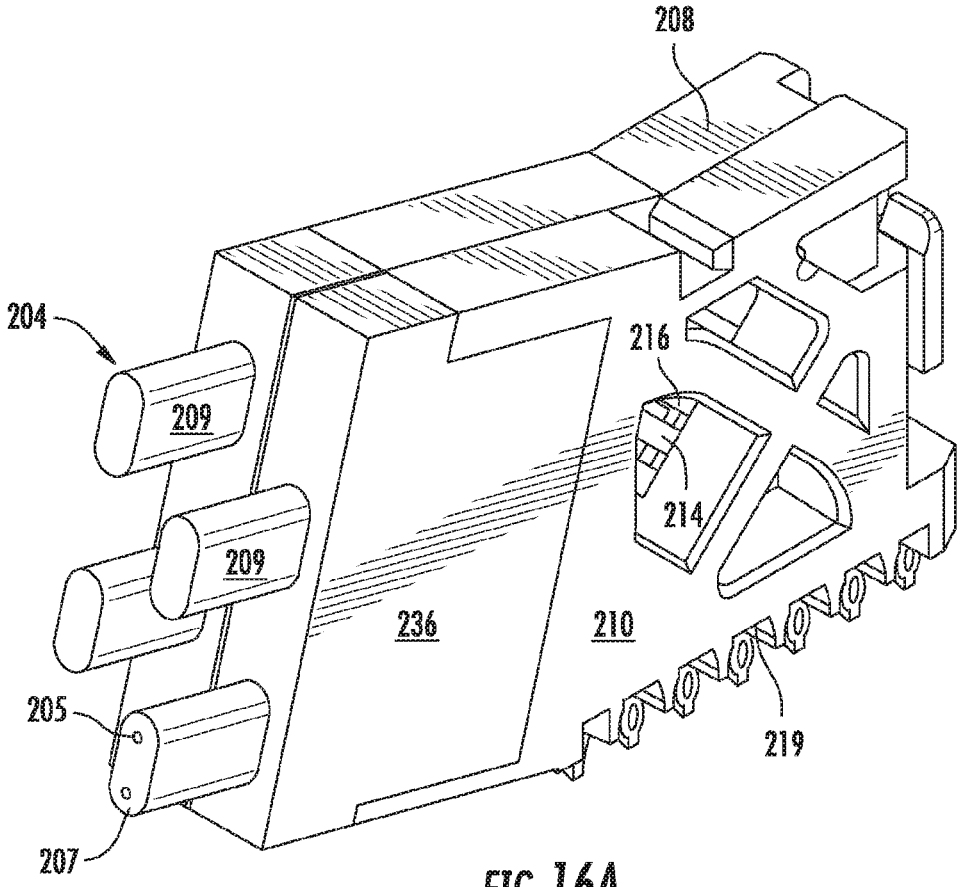
FIG. 16A is the same view as FIG. 16, but illustrating only a pair of wafer connector halves.
Figure 16B:
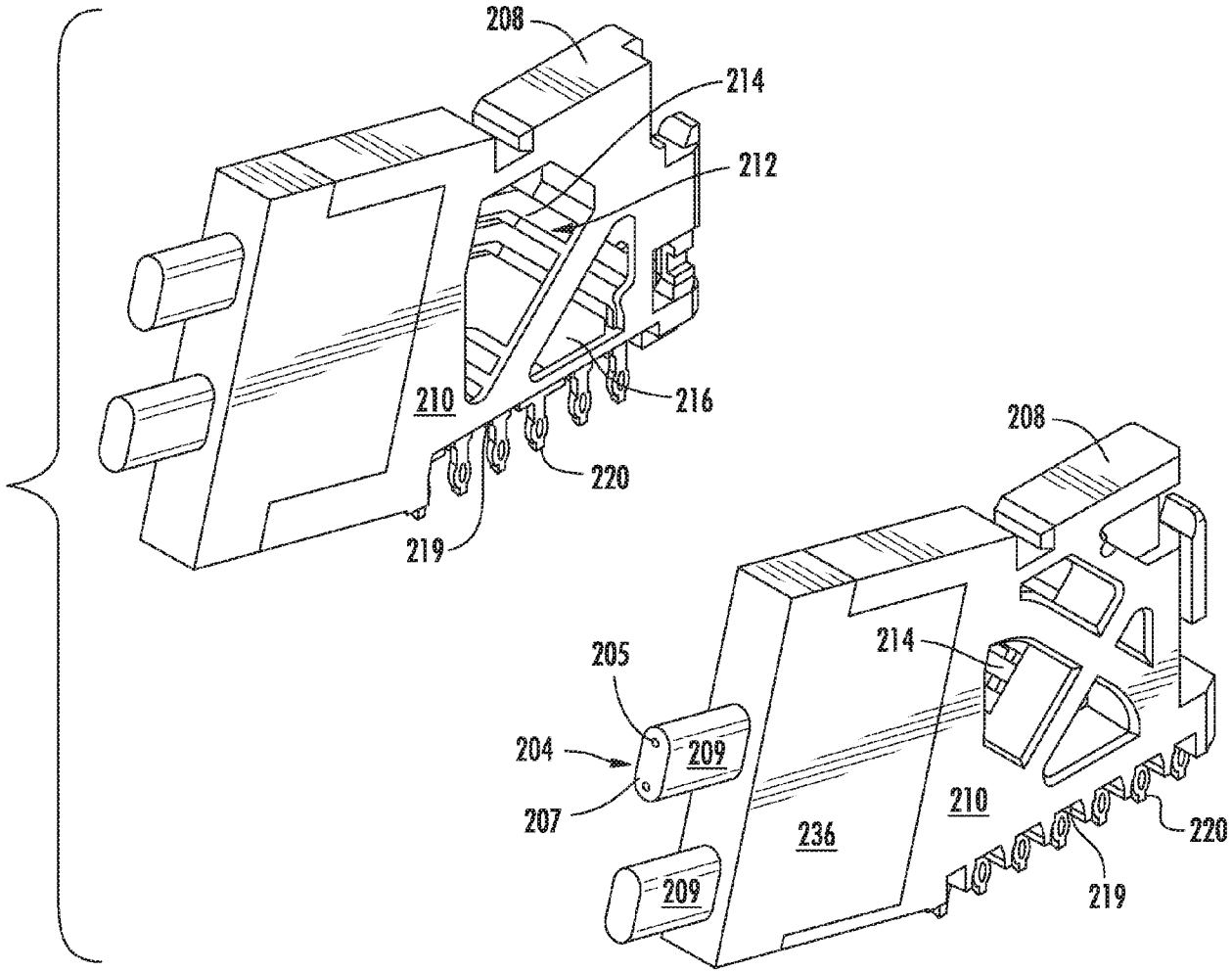
FIG. 16B is the same view as FIG. 16A, but with the wafer connector halves separated.
Figure 16C:
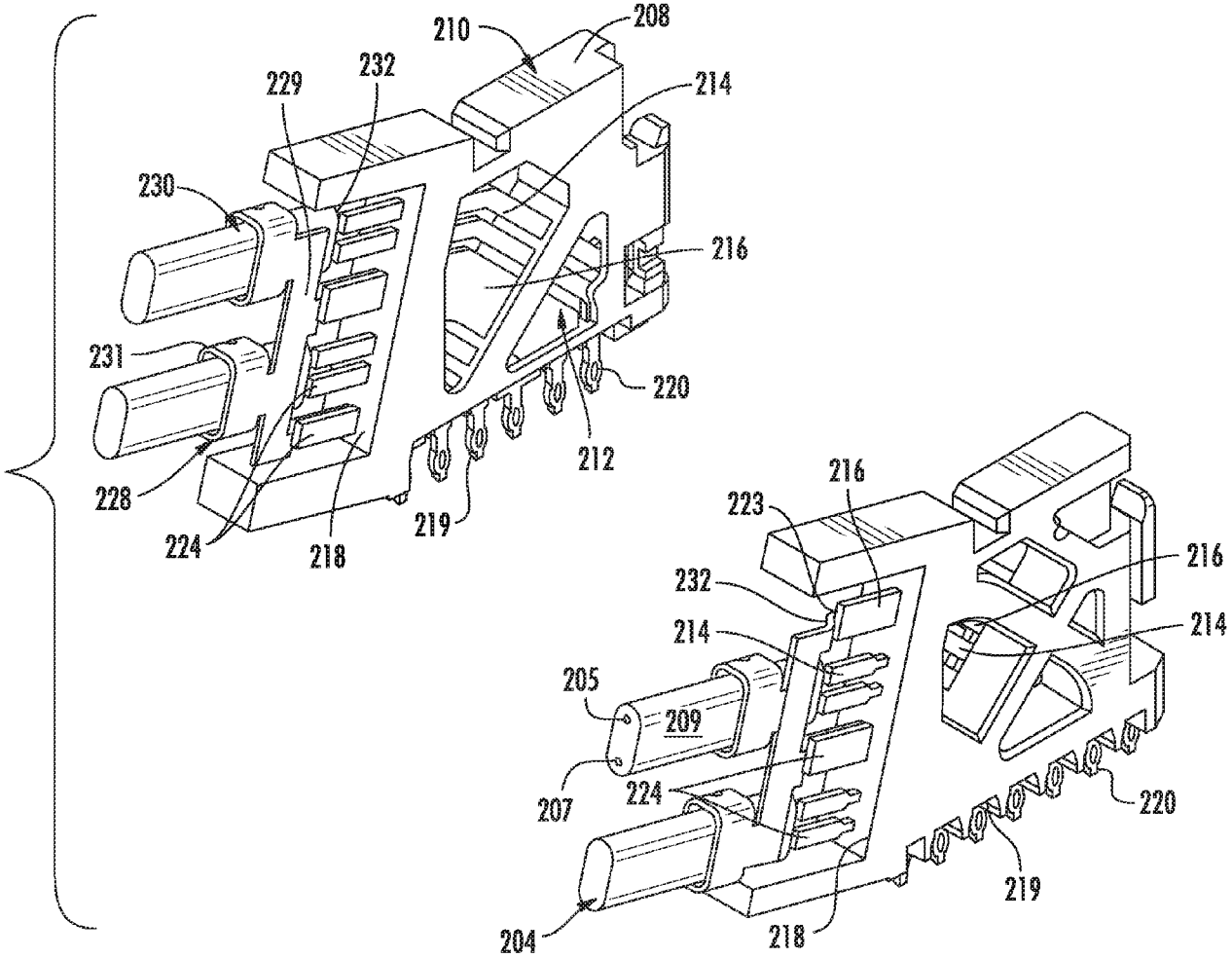
FIG. 16C is the same view as FIG. 16B, but with the overmold removed for clarity and illustrating another ground member which is also used to position the twin-ax wires for termination.
Figure 16D:
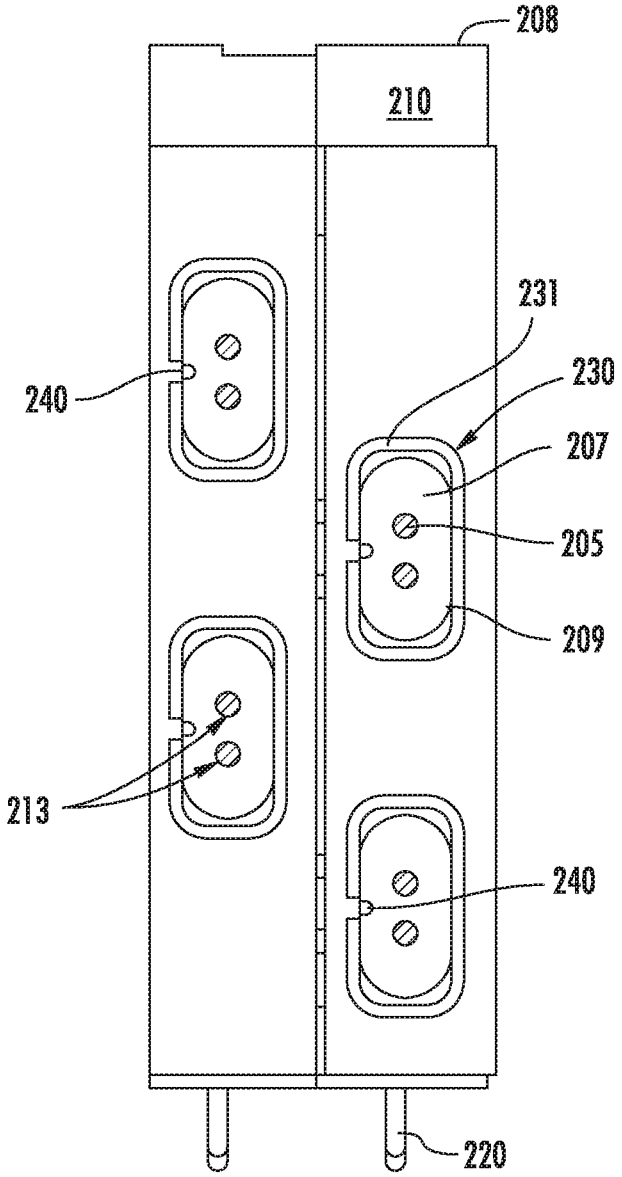
FIG. 16D is an end view of the wafer connector of FIG. 16A, taken along lines D-D thereof.
Figure 17:
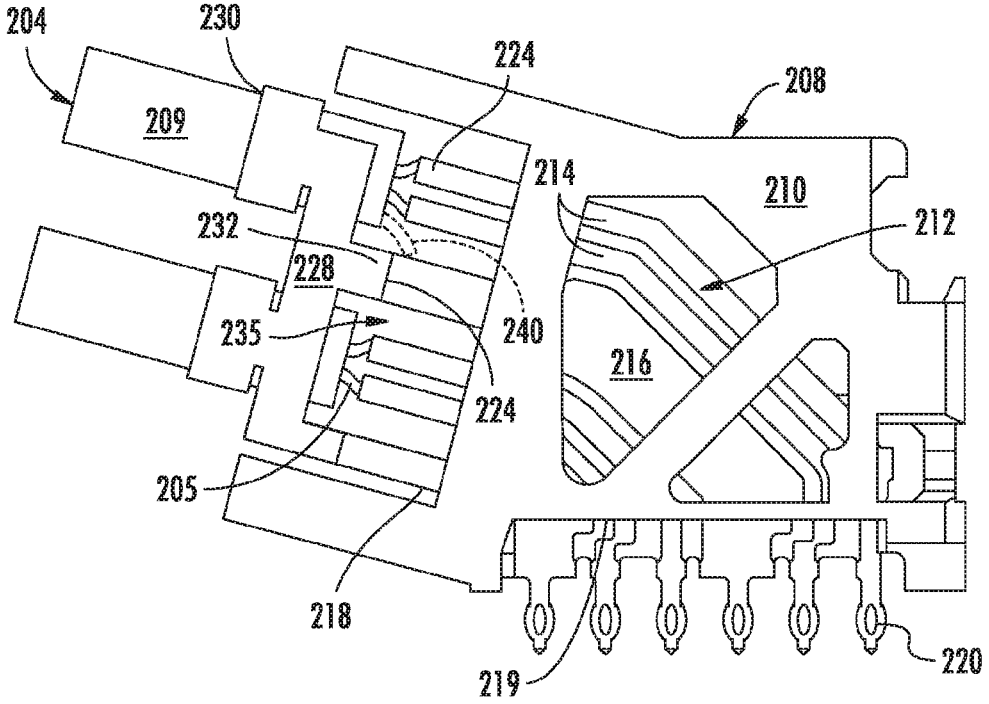
FIG. 17 is an elevational view of the near side of the rightmost wafer connector half of FIG. 16C.
Figure 17A:
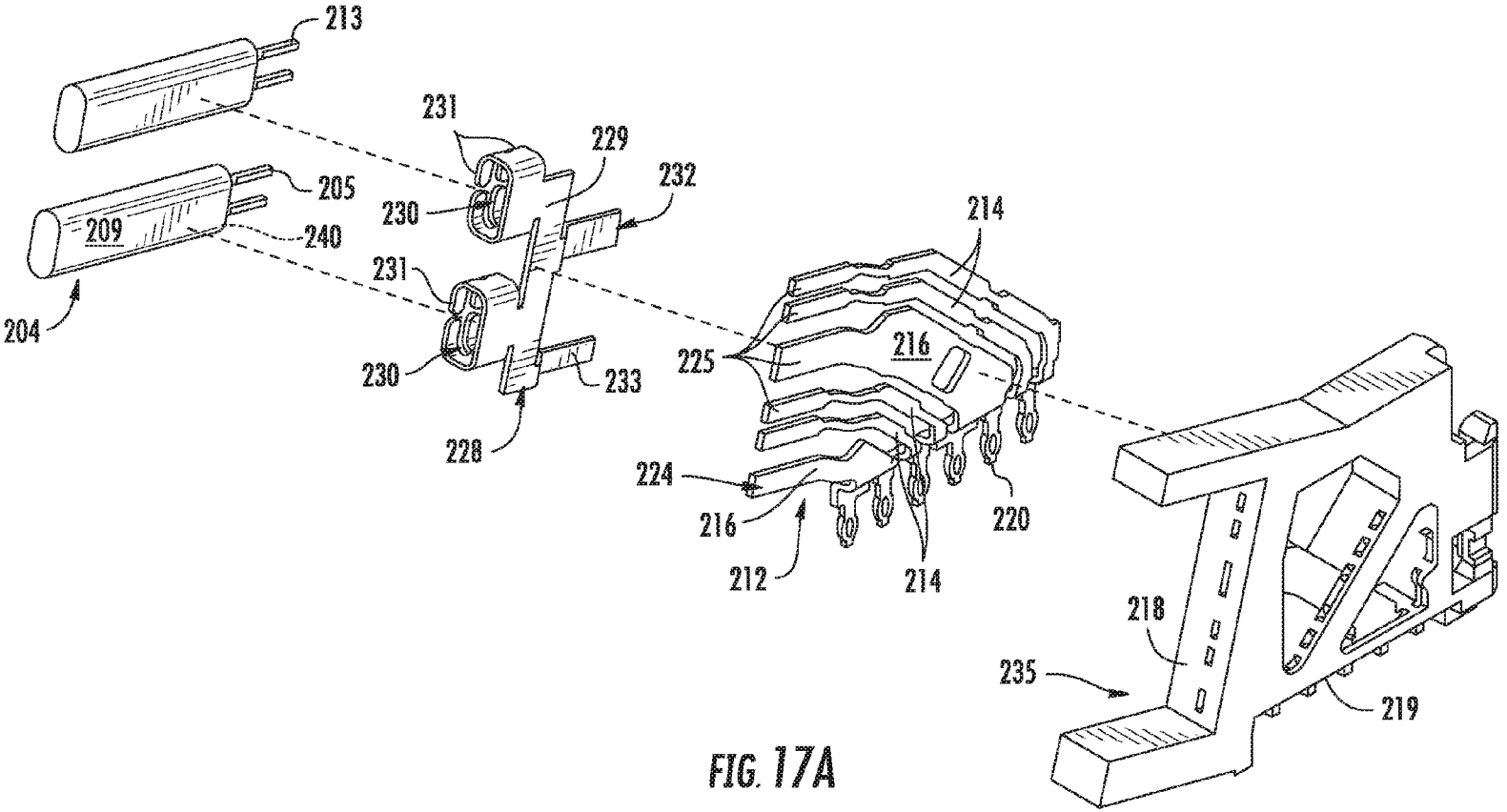
FIG. 17A is an exploded view of the wafer connector half of FIG. 17.

FIG. 16 illustrates a plurality of wafer connectors 208 which are grouped together in a stack. Each wafer connector 208 has an insulative frame, or housing 210, that supports, as best illustrated in FIG. 17A, a plurality of conductive terminals 212. The terminals 212 are shown as two distinct types of first and second terminals 214, 216, with the first, or "signal", terminals 214 being designated and structured for the transmission of data signals, and the second, or "ground" terminals 216 being designated and structured to provide grounds for the signal terminals 214. As seen in FIG. 17A and other of the Figures, there is at least one ground terminal 216 that flanks a pair of signal terminals 214, and preferably, at least one ground terminal 216 is interposed between adjacent pairs of signal terminals 214. In some applications, ground terminals 216 will flank each pair of the signal terminals 214 in each connector 208, and in other applications, all pairs will be flanked with the exception of an end pair, as is shown in FIG. 17A. The wafer connector frame 210 supports the terminals 212 in a fashion such that the opposing free ends of the terminals are arrayed along two distinct sides 218, 219 of the frame 210. The sides 218 of the wafer connectors 218 are mating sides to which the cable wires 204 are terminated, while the side 219 are mounting sides that mate with the circuit board 202. The sides are illustrated in this embodiment as disposed adjacent to each other, but they can be also oriented at opposite ends of the connectors 208.

In this embodiment, the one free ends of the terminals along the mounting sides 219 of the connectors 208 are formed as compliant pins 220, and they define mounting ends 222 of the terminals 212. These compliant pins 220 are received within vias located in the circuit board 202 (not shown). The other terminal free ends are structured as tail ends 224 with flat contact surfaces 225 that engage the free ends 213 of the signal conductors 205 of the twin-ax wires 204. The tail ends 224 of the first (signal) terminals 214 are contacted by the free ends 213 of the twin-ax wire signal conductors 205.

As illustrated in FIGS. 16C-19D, a single ground member 228 is preferably provided for each connector 208 and the ground member preferably serves multiple functions. First, it supports and conductively engages the outer shields 209 of the twin-ax wires 204. Secondly, it preferably interconnects the tail ends of the ground terminals 216 together (along with the corresponding wire outer shields 209) to form a continuous and low impedance ground path within the termination areas of the wafer connectors 208. This particular ground member 228 differs the prior embodiments in that it is continuous in configuration. The ground member 228 includes a body portion 229 that is shown as an elongated, planar ground strip. It extends at an angle, preferably transversely to the tails of all of the wafer connector terminals 212. As shown in the Figures, especially FIG. 19C, the ground member 228 has a configuration that is best described as two interconnected L-shape segments. The L-shaped segments may be considered as being stacked on top of each other and cooperatively they define a ground path that partially surrounds each pair of signal (first) terminals 216. It can be seen from FIG. 18, that the ground member 228 runs alongside and thereby surrounds three sides of the one pair of signal terminals, and runs alongside two sides of the other pair of signal terminals. In both instances, the L-shaped segments run along one lengthwise side of each signal terminal pair and along one widthwise side of each signal terminal pair, namely the free ends 213 of the first terminals 216.

One or more grounding nests, or cradles 230, are provided as part of the ground members 228 and these are spaced apart from the body portion 229 and connected thereto as illustrated. The nests 230 preferably have a plurality of elongated contact arms 231 that extend generally parallel to the body portion 229 and which are configured to permit them to be folded over the wires 204 during assembly such as by way of a crimping process to make electrical contact with the outer shielding member 209 of the twin-ax wires 204. The ground member 228 may further include contact legs, or tabs 232, that extend away from it at an angle, shown as extending perpendicularly in the Figures. The contact tabs 232 make contact with the tails of the ground terminals 216 of the wafer connector 208. These tabs 232 are connected to the ground terminal tails in a suitable manner, such as by welding, soldering, clamping or the like, with welding being the most useful manner of attachment.

The contact arms 231 of the ground member nests 230 are folded over onto the outer shielding members 209 of the corresponding twin-ax wires 204. The nests 230 are further preferably positioned with respect to the ground member 228 to position the signal conductor free ends 213 of the twin-ax wires 204 in a desired termination position where they contact the flat contact surfaces 225 of signal terminal tail ends 224, or very close thereto so as to require minimal bending of the signal conductors 205 into desired contact. These conductor free ends 213 may have flat portions formed thereon as shown in FIG. 17A for attachment to the first terminals 214. Consequently, the grounding strip contact tabs 232 may be formed with an offset such that the free ends 233 of the contact tabs 232 extended away from the ground member body portion 229. Preferably, the contact tab free ends 233 lie in a plane spaced apart and generally parallel to a second plane in which the ground member body portion 229 extends. The contact tab free ends 233 further lie in a plane that is spaced apart from a plane defined by pairs of the first terminals 214. In this manner, the outer surfaces of the signal conductors 205 are aligned with the ground terminal contact surfaces 225 to preferably lay as flat as possible thereon. The free ends 213 of the cable wires 204 are also maintained within the termination areas 235 defined in the connectors 208, which is later covered by a dielectric material 236 by way of overmolding or the like. Although the offset is shown in the Figures as part of the contact tabs 233, it will be understood that it may be formed as part of the second (ground) terminals 216. In similar instances the tails of the second terminals may be structured so as to contact the ground member 228 in a plane different than the plane that is occupied by most of the second terminals 216. The cable wire free ends 213 are also positioned between and within the boundaries of the wafer connector bodies to ensure the wafer connectors 208 all have a uniform, or other desired thickness.

While a preferred embodiment of the Present Disclosure is shown and described, it is envisioned that those skilled in the art may devise various modifications without departing from the spirit and scope of the foregoing Description and the appended Claims.

What is claimed is:

1. A bypass cable assembly, comprising:

a chip package supported on a circuit board;

a plurality of cables including a first and second cable, each of the plurality of cables including an insulative body portion with a pair of associated signal conductors extending lengthwise through the insulative body portion, the signal conductors of each pair being spaced apart, each cable of the plurality of cables including a ground shield that extends around the insulative body portion, the ground shield and signal conductors having opposing first and second free ends, wherein the first free ends of the signal conductors are terminated to circuits on the circuit board adjacent to and in communication with the chip package; and a connector that includes a body that supports a first pair of signal terminals and a first ground terminal in a row, the signal terminals of the first pair of signal terminals each including a contact portion and a tail portion, the tail portions of the first pair of signal terminals being connected to the signal conductors of the first cable, the first ground terminal including a contact that is positioned adjacent the contacts of the first pair of signal terminals and being connected to the ground shield of the first cable so that the connector and plurality of cables help provide a differential coupled channel between the contacts of the first pair of signal terminals and the circuit board.

2. The bypass cable assembly of claim 1, wherein the row is a first row, the connector includes a second pair of signal terminals and a second ground terminal in a second row, the signal terminals of the second pair of signal terminals each including a contact portion and a tail portion, the tail portions of the second pair of signal terminals being connected to the signal conductors of the second cable, the second ground terminal including a contact that is positioned adjacent the contacts of the second pair of signal terminals and being connected to the ground shield of the second cable.

3. The bypass cable assembly of claim 2, wherein the bypass cable assembly is configured to support 15 GHz signaling.

4. The bypass cable assembly of claim 2, wherein the two rows of terminals are each supported by a separate frame that is positioned in the body.

5. The bypass cable assembly of claim 1, wherein the first pair of signal terminals is arranged so that the pair of signal contacts have ground contacts on both sides of the pair of signal contacts and the ground shield is electrically connected to the ground contacts on both sides of the pair of signal contacts.

6. The bypass cable assembly of claim 5, wherein a second connector connects the first free end to the circuit board adjacent the chip package so as to provide the termination.

7. The bypass cable assembly of claim 1, wherein a second connector connects the first free end to the circuit board adjacent the chip package so as to provide the termination.

8. The bypass cable assembly of claim 1, wherein the first cable includes a drain wire.

9. The bypass cable assembly of claim 1, wherein the row includes a second pair of signal terminals, the first and second pair of signal terminals separated from each other by at least one terminal, wherein each terminal in the second pair of signal terminals includes a contact portion and a tail portion, the tail portions of the second pair of signal terminals connected to the pair of conductors in the second cable, wherein a second ground terminal is positioned adjacent the second pair of signal terminals and the ground shield of the second cable is connected to the second ground terminal.

10. A bypass cable assembly, comprising:

a chip package supported on a circuit board;

a plurality of cables including a first cable and a second cable, each cable of the plurality of cables including an insulative body portion with a pair of associated signal conductors extending lengthwise through the insulative body portion, the signal conductors of each pair being separated by a first spacing and further including a ground shield extending around the insulative body portion, the ground shield and signal conductors having opposing first and second free ends, wherein the first free ends of the signal conductors are electrically connected to circuits on the circuit board adjacent to and in communication with the chip package; and a connector that includes a body that supports a pair of signal terminals and a ground terminal in a row, the pair of signal terminals each including a contact portion and a tail portion, the tail portions of the pair of signal terminals being connected to the signal conductors of the first cable, the ground terminal including a contact that is positioned adjacent the contacts of the pair of signal terminals and that is connected to the ground shield of the first cable so that the connector and plurality of cables help provide a differential coupled channel between the contacts of the pair of signal terminals and the circuit board.

11. The bypass cable assembly of claim 10, wherein the row is a first row, the connector includes a second pair of signal terminals and a second ground terminal in a second row, the signal terminals of the second pair of signal terminals each including a contact portion and a tail portion, the tail portions of the second pair of signal terminals being connected to the signal conductors of the second cable, the second ground terminal including a contact that is positioned adjacent the contacts of the second pair of signal terminals and being connected to the ground shield of the second cable.

12. The bypass cable assembly of claim 11, wherein the bypass cable assembly is configured to support 15 GHz signaling.

13. The bypass cable assembly of claim 11, wherein the two rows of terminals are each supported by a separate frame that is positioned in the body.

14. The bypass cable assembly of claim 10, wherein the first pair of signal terminals is arranged so that the pair of signal contacts have ground contacts on both sides of the pair of signal contacts and the ground shield is electrically connected to the ground contacts on both sides of the pair of signal contacts.

15. The bypass cable assembly of claim 14, wherein a second connector electrically connects the first free end to the circuit board adjacent the chip package.

16. The bypass cable assembly of claim 10, wherein a second connector electrically connects the first free end to the circuit board adjacent the chip package.

17. The bypass cable assembly of claim 10, wherein the first cable includes a drain wire.

18. The bypass cable assembly of claim 10, wherein the row includes a second pair of signal terminals, the first and second pair of signal terminals separated from each other by at least one terminal, wherein each terminal in the second pair of signal terminals includes a contact portion and a tail portion, the tail portions of the second pair of signal terminals connected to the pair of conductors in the second cable, wherein a second ground terminal is positioned adjacent the second pair of signal terminals and the ground shield of the second cable is connected to the second ground terminal.

* * * * *